US007455285B2

(12) United States Patent
Goh et al.

(10) Patent No.: US 7,455,285 B2
(45) Date of Patent: Nov. 25, 2008

(54) MEDIA HANDLING ACCESSORY AND METHOD

(75) Inventors: Eng-Long Goh, San Diego, CA (US); Howard G. Wong, Portland, OR (US); Miquel Boleda, San Diego, CA (US); Dennis Sonnenburg, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 556 days.

(21) Appl. No.: 11/042,254

(22) Filed: Jan. 25, 2005

(65) Prior Publication Data

US 2006/0163799 A1 Jul. 27, 2006

(51) Int. Cl.
*B65H 5/22* (2006.01)

(52) U.S. Cl. ..... 271/3.14; 271/3.01; 399/373; 399/374

(58) Field of Classification Search ..... 271/3.14, 271/3.01; 399/374, 373
See application file for complete search history.

(56) References Cited

U.S. PATENT DOCUMENTS 3,901,594 A * 8/1975 Robertson ..... 355/18
4,058,196 A 11/1977 Rempel
4,435,718 A * 3/1984 Clark et al. ..... 347/104
4,671,686 A 6/1987 Howes et al.
4,787,616 A * 11/1988 Sasaki et al. ..... 271/3.03
4,995,745 A 2/1991 Yokoi et al.
5,022,640 A * 6/1991 Greco, Jr. ..... 271/3.05
5,164,906 A 11/1992 Mahmoodi et al.
5,596,399 A * 1/1997 Dempsey et al. ..... 399/45
5,615,872 A * 4/1997 Mochimaru ..... 271/3.14
5,737,682 A * 4/1998 Yamagishi ..... 399/402
6,000,870 A 12/1999 Koga
6,015,143 A * 1/2000 Jimenez et al. ..... 271/4.1
6,016,156 A 1/2000 Urakawa
6,022,012 A * 2/2000 Worley ..... 271/3.14
6,290,410 B1 * 9/2001 Sunada et al. ..... 400/624
6,325,503 B1 12/2001 McCue, Jr. et al.
6,332,068 B2 * 12/2001 Blackman et al. ..... 399/364
6,350,072 B1 * 2/2002 Nunes et al. ..... 400/188
6,364,553 B1 * 4/2002 McCue et al. ..... 400/625
6,659,667 B2 12/2003 McCue, Jr. et al.
2001/0005463 A1 6/2001 Blackman
2002/0127043 A1 9/2002 McCue, Jr. et al.
2003/0011121 A1 * 1/2003 Kobayashi et al. ..... 271/3.14
2003/0047860 A1 * 3/2003 Takamatsu ..... 271/3.14
2003/0184635 A1 10/2003 Castleberry
2004/0089992 A1 * 5/2004 Makino ..... 271/3.14
2004/0091283 A1 5/2004 Nobe et al.
2004/0101338 A1 5/2004 McCue, Jr. et al.
2004/0188912 A1 * 9/2004 Kobayashi ..... 271/3.14
2004/0201159 A1 * 10/2004 Sheng et al. ..... 271/3.14

* cited by examiner

*Primary Examiner*—Patrick H Mackey
*Assistant Examiner*—Prasad V Gokhale

(57) ABSTRACT

Example embodiments of a media handling accessory and method are illustrated and described, wherein the accessory includes a media input tray and a duplexing path.

50 Claims, 12 Drawing Sheets

FIG. 1
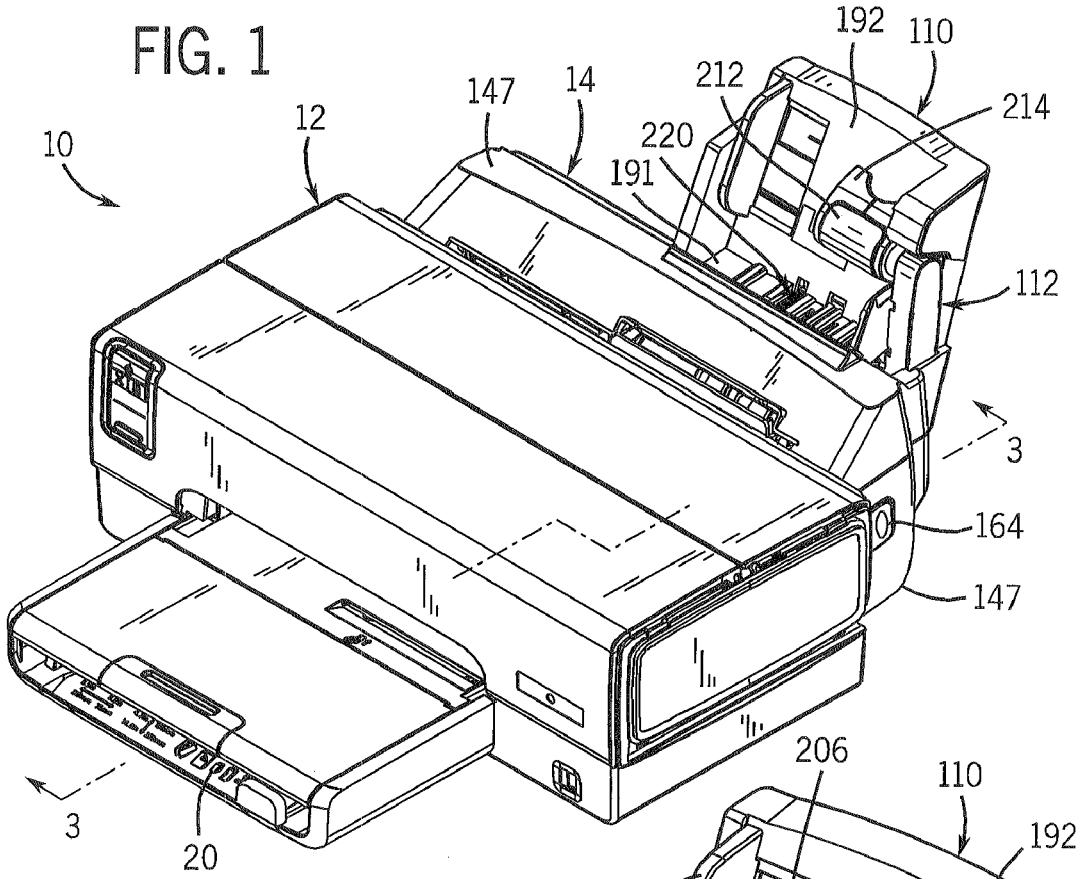
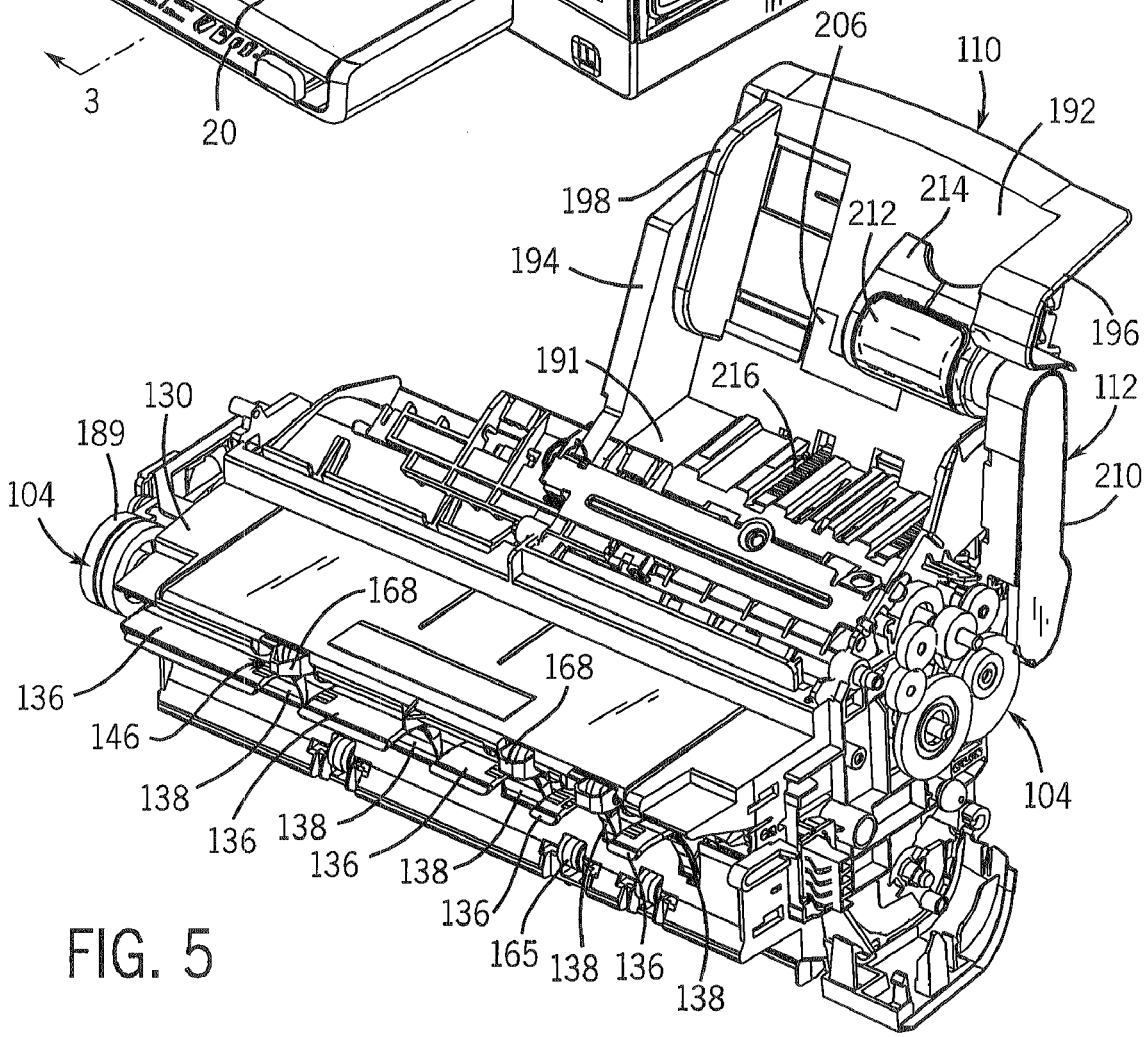
FIG. 5

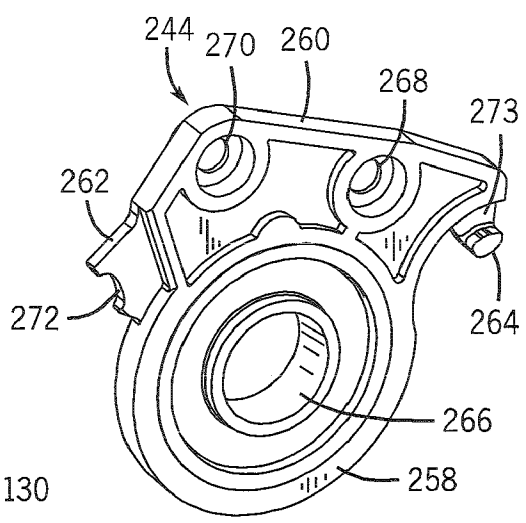
FIG. 8
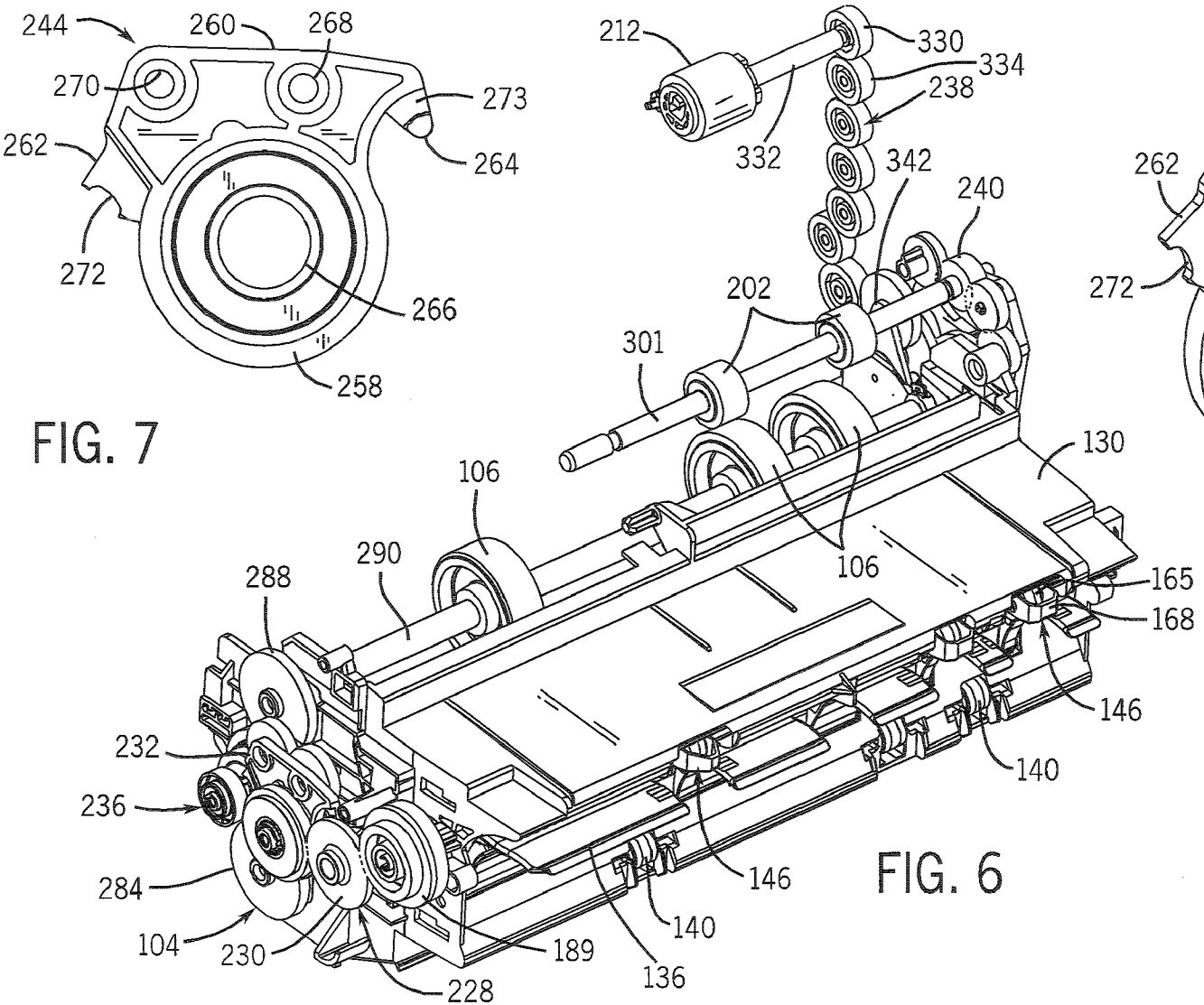
FIG. 6
FIG. 7

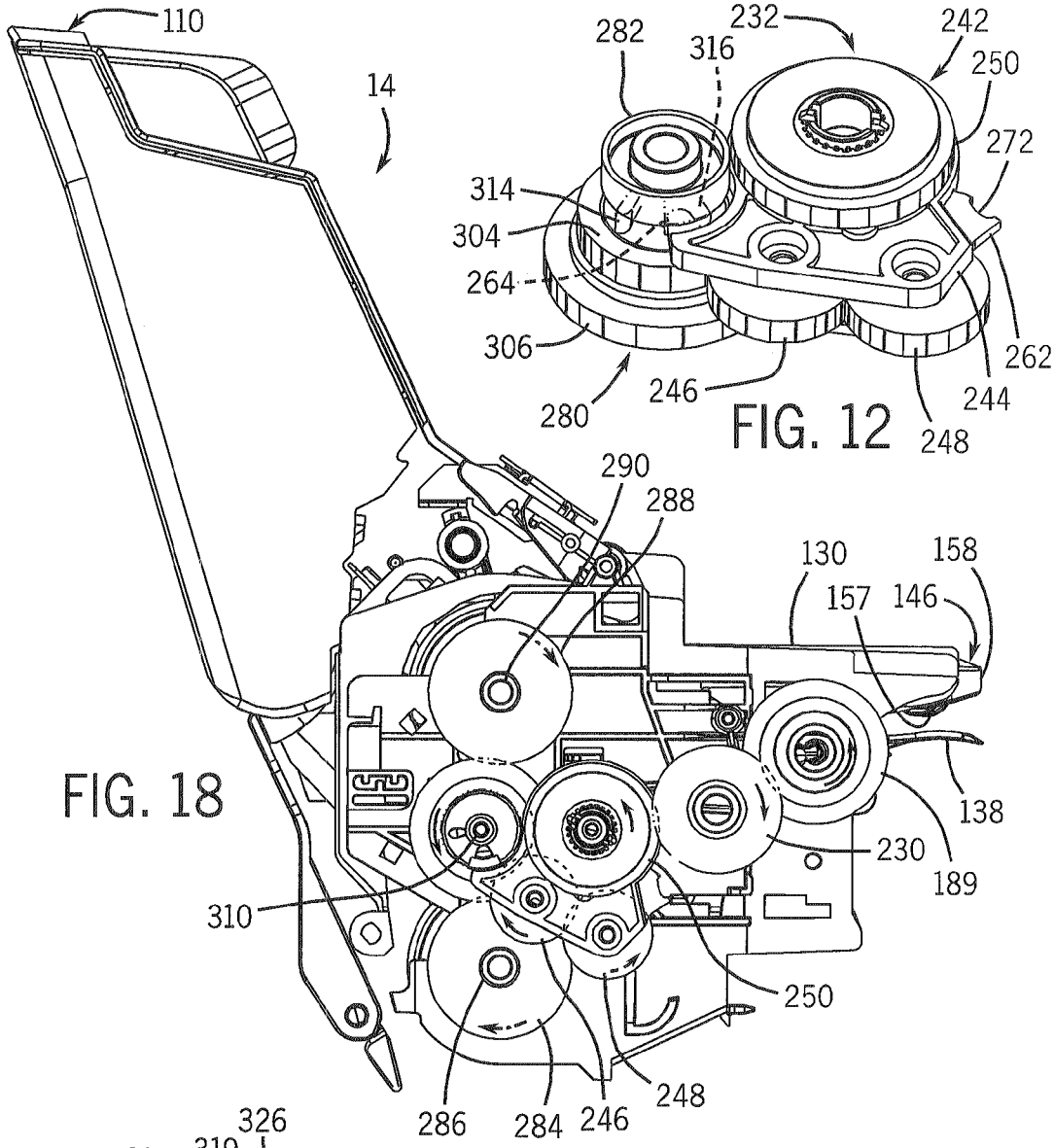
FIG. 12
FIG. 18
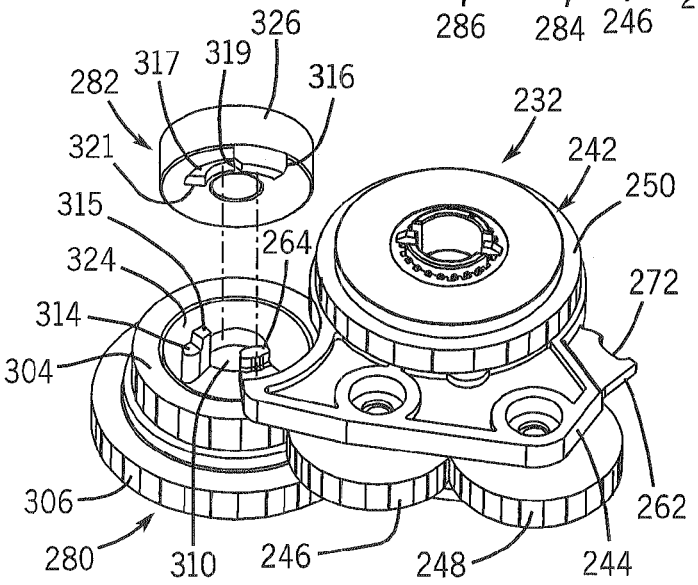
FIG. 11

MEDIA HANDLING ACCESSORY AND METHOD

CROSS-REFERENCE TO RELATED PATENT APPLICATIONS

The present application is related to co-pending U.S. patent application Ser. No. 11/042,251 entitled MEDIA HANDLING SYSTEM and filed on Jan. 25, 2005 by Miquel Boleda, the full disclosure of which is hereby incorporated by reference.

BACKGROUND

Many of today's printer are capable of performing multiple functions, such as printing, duplexing, and using multiple types of print media. Although potentially having greater versatility, such printers may be larger and may be more expensive due to the additional parts and complexity. In addition, such printers may employ extra motors or more powerful motors to provide energy for performing the additional functions.

BRIEF DESCRIPTION OF THE DRAWINGS

FIG. 1 is a top perspective view of a media handling system including a main unit and an accessory according to one exemplary embodiment.

FIG. 5 is a top perspective view of the accessory of FIG. 2 with portions removed for purposes of illustration according to one exemplary embodiment.

FIG. 6 is a top perspective view of the accessory of FIG. 2 with portions removed for purposes of illustration according to one exemplary embodiment.

FIG. 7 is a side elevational view of a swing arm of the accessory according to one exemplary embodiment.

FIG. 8 is a perspective view of the swing arm of FIG. 7 according to one exemplary embodiment.

FIG. 11 is a top perspective view of one example of the swing arm assembly and the duplex power train of FIG. 9 in a partially disassembled state according to one exemplary embodiment.

FIG. 12 is a top perspective view of the swing arm assembly and the duplex power train of FIG. 11 in an assembled state according to one exemplary embodiment.

FIG. 18 is a side elevational view of the accessory of FIG. 2 in a paper pick mode according to one exemplary embodiment.

DETAILED DESCRIPTION OF THE EXAMPLE EMBODIMENTS

Figure 2:
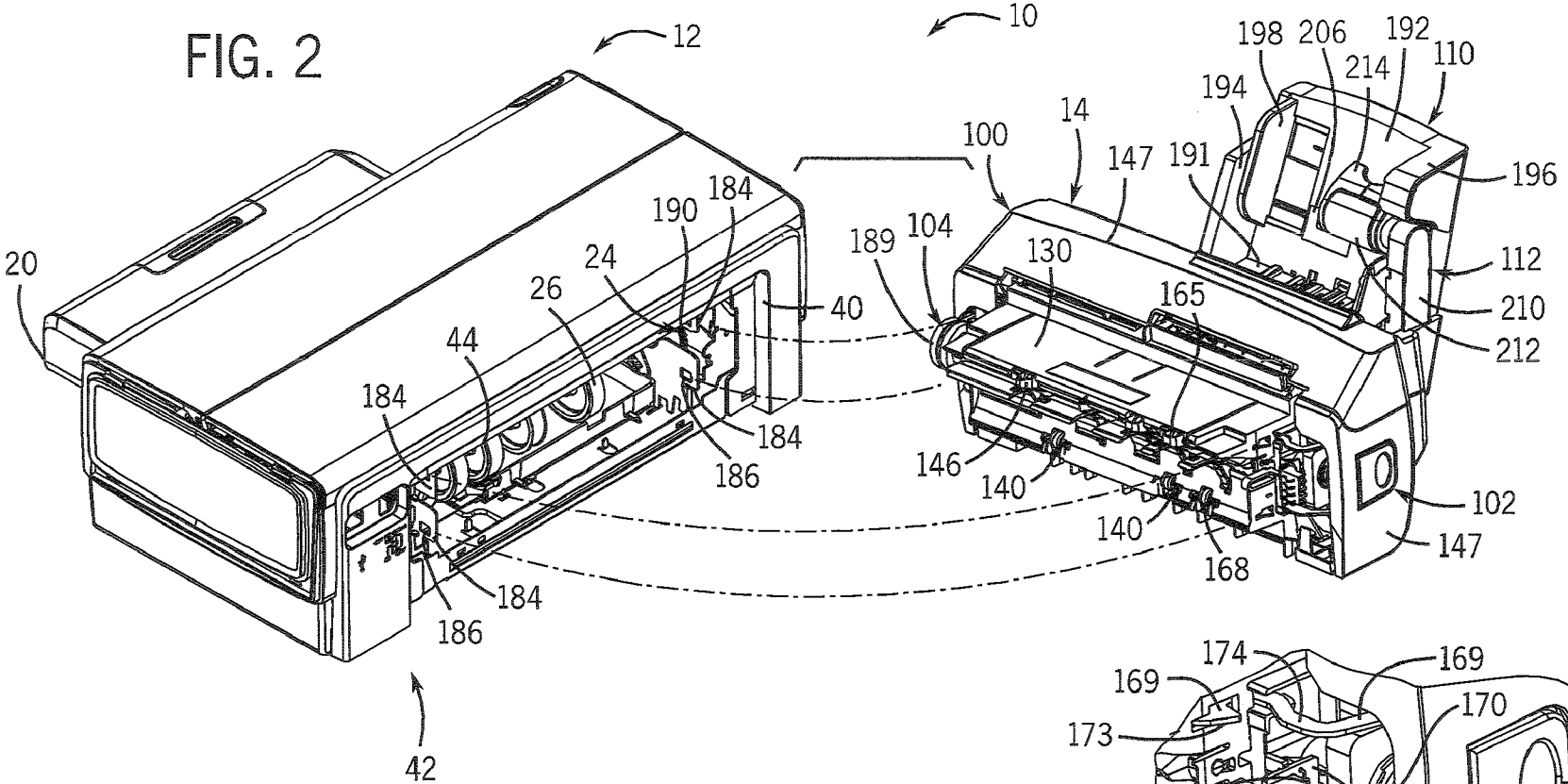
FIG. 2 is a top perspective view of the media handling system of FIG. 1 illustrating the accessory separated from the main unit according to one exemplary embodiment.
Figure 3:
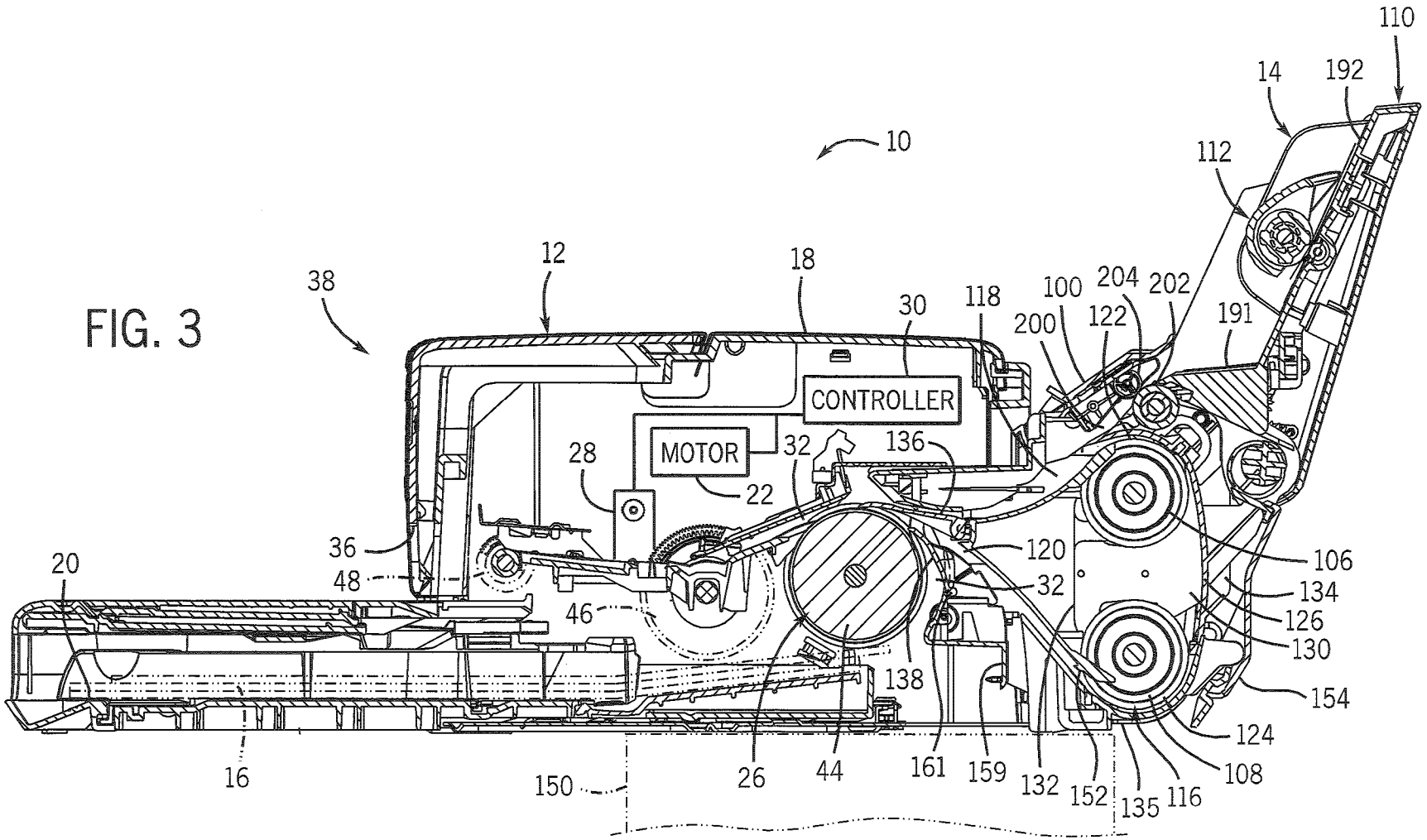
FIG. 3 is a sectional view of the media handling system of FIG. 1 taken along line 3-3 according to one exemplary embodiment.

FIGS. 1-3 illustrate media handling system 10 which is configured to manipulate and interact with sheets of media. In particular, media handling system 10 is configured to interact with multiple sides of a sheet of media and is configured to deliver sheets of media from multiple input trays. Although media handling system 10 is specifically described and illustrated as being capable of interacting with multiple sides of a sheet of print media by printing upon multiple sides of a sheet of print media, media handling system 10 may alternatively be configured to interact with sheets of media in other fashions such as scanning and the like.

As shown by FIG. 2, media handling system 10 includes two main components: main unit 12 and accessory 14. In the particular embodiment illustrated, main unit 12 comprises a stand alone unit capable of operating independent of accessory 14. In the particular embodiment illustrated, main unit 12 comprises a printer configured to print upon a sheet 16 of media (shown in FIG. 3). As shown by FIG. 3, main unit 12 generally includes housing 18, input tray 20, motor 22, transmission 24 (FIG. 2), media feed 26, print device 28 and controller 30. Housing 18 generally comprises an assembly of one or more panels and structures configured to enclose or substantially support the remaining components of main unit 12. Housing 18 cooperates with other components of main unit 12 to form media path 32 along which media from input tray 20 travels within main unit 12 prior to and after being printed upon by printing device 28. Housing 18 forms an output opening 36 through which printed upon media is expelled from main unit 12. In the particular embodiment illustrated, output opening 36 is arranged such that printed upon media is expelled from a front 38 of main unit 12 generally above input tray 20. In other embodiments, output opening 36 may be arranged at other locations depending upon the particular arrangement of media feed 26, print device 28 and media path 32.

As shown by FIGS. 2 and 3, housing 18 further includes an opening 40 along a rear 42 of main unit 12. When main unit 12 is being used independent of accessory 14, opening 40 may be covered or closed by a closable door (not shown) of housing 18 which cooperates with media feed 26 to form media path 32 and to guide movement of media along media path 32. Movement or removal of the door (not shown) to expose opening 40 provides access to media path 32 to clear media jams along media path 32. Movement or removal of the door (not shown) exposes opening 40 which further enables accessory 14 to be removably mounted to main unit 12 as will be described in greater detail hereafter.

Media input tray 20 is configured to store a single sheet or a stack of multiple sheets of media. In the particular example shown, media input tray 20 extends from a front 38 of main unit 12. In other embodiments, media input tray 20 may extend in other locations relative to a remainder of main unit 12. In the particular example illustrated, media input tray 20 is configured to hold sheets of print media such as 8½ inch by 11 inch sheets, A4 size media and the like. In other embodiments, tray 20 may be configured to hold smaller or larger media.

Motor 22 (schematically shown in FIG. 3) comprises an electric motor operably coupled to media feed 26 by transmission 24 (shown in FIG. 2). In the particular embodiment illustrated, motor 22 is further operably coupled to print device 28 by transmission 24. In other embodiments, an alternative motor or drive system may be used for moving print device 28 relative to media or print device 28 may be stationarily supported such as in a page-wide-array printer arrangement. Motor 22 supplies torque to rotatably drive media feed 26 so as to move media through main unit 12 along media path 32.

Transmission 24, only a portion of which is shown, includes a plurality of components configured to transmit torque from motor 22 to media feed 26 and potentially to print device 28. Transmission 24 may comprise a series of gears, belts, pulleys, chains and the like for transmitting such torque and for adjusting the rotational speed and torque being transmitted.

As shown by FIG. 3, media feed 26 comprises a series of members configured to engage and move media from tray 20, relative to print device 28 and through outlet or discharge port 36. In the particular embodiment shown, portions of media feed 26 are further configured to move media from accessory 14 relative to print device 28 and through discharge port 36. Media feed 26 is further configured to move media from main unit 12 into accessory 14 where the media may be overturned or duplexed. In the particular example shown, media feed 26 includes pick roller 44, feed roller 46 and feed roller 48. Pick roller 44 engages a sheet 16 of media to move the media about pick roller 44 along media path 32 and across print device 28. Media feed 26, which is operably coupled to transmission 24, may also be used to move media from main unit 12 into accessory 14. Feed roller 46 is configured to engage media to further control the movement of media relative to print device 28 such as during borderless printing. Feed roller 48 comprises one or more rollers, such as star rollers, configured to further engage and control the movement of media as the media is being printed upon by print device 28. Feed roller 48 further moves the media through discharge port 36. Although media feed 26 is illustrated as including a series of rollers, media feed 26 may alternatively include other devices, such as belts, configured to move media within main unit 12 as the media is being printed upon or otherwise being interacted upon.

Print device 28 comprises a device configured to print or otherwise form an image upon the print medium. In the particular embodiment illustrated, print device 28 is configured to deposit ink upon a print medium. In one embodiment, print device 28 comprises an inkjet printhead. In other embodiments, print device 28 may include other devices configured to print upon a medium such as a dye sublimination printhead, electrophotographic drum or belt, electrographic drum or belt, or other such printing devices.

In the particular embodiment shown, print device 28 is movably supported by a carriage, enabling print device 28 to be transversely scanned across a width of a print medium being moved relative to print device 28 by media feed 26. In other embodiments, print device 28 may alternatively extend across an entire width of the print medium printed upon.

Controller 30 comprises a processing unit in communication with motor 22 and print device 28. For purposes of this disclosure, the term "processing unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 30 is not limited to any specific combination of hardware circuitry and software, nor to any particular source for the instructions executed by the processing unit.

Controller 30 generates control signals which direct the operation of motor 22 to drive media feed 26 and, in particular embodiments, a carriage (not shown) to move print device 28 relative to print media. Controller 30 further generates control signals which direct the operation of print device 28. In addition, controller 30 receives signals from one or more sensors (not shown) detecting whether accessory 14 is connected to main unit 12. In response to accessory 14 being connected to main unit 12, signals from the sensor are transmitted to controller 30 which generates control signals directing a display indicating the availability of media handling options provided by accessory 14 to a user of system 10.

Accessory 14 comprises a module or a supplemental unit configured to be releasably or removably attached to main unit 12 and to main unit 12 and to perform one or more media handling operations. In the particular embodiment illustrated, accessory 14 is configured to provide an alternative, or additional, source of print media and to facilitate overturning or duplexing of media. In other embodiments, accessory 14 may be configured to provide additional or alternative media handling operations such as media folding, stapling, collating, stacking and the like.

Accessory 14 generally includes body 100, latch mechanisms 102, transmission 104, rollers 106, 108, media input tray 110 and media pick mechanism 112. Body 100 supports the remaining components of accessory 14 and cooperates with rollers 106, 108 to form a duplexing path 116 through which media is overturned. In one embodiment, duplex path is at least 11.69 inches long, enabling A4 size media to be duplexed. In other embodiments, path 116 may have other lengths.

As shown by FIG. 3, duplex path 116 includes entry and exit portions 118, 120, media turning portions 122, 124 and intermediate portion 126. Entry and exit portions 118, 120 are those portions of media path 116 through media enters and exits media duplex path 116. Overturning portions 122, 124 are those portions of media duplex path 116 in which the media is turned. In the particular example shown, overturning portions 122 and 124 arcuately extend about the rotational axes of rollers 106 and 108. Intermediate portion 126 extends between overturning portions 122 and 124. Because media duplex path 116, and specifically because overturning portions 122 and 124 are within accessory 14, main unit 12 may omit such additional structures or guides for overturning media in a duplexing operation, enabling main unit 12 to be more compact, less complex and less expensive. At the same time, because media path 116 is substantially subjacent to media input tray 110, accessory 14 is itself more compact.

Figure 3A:
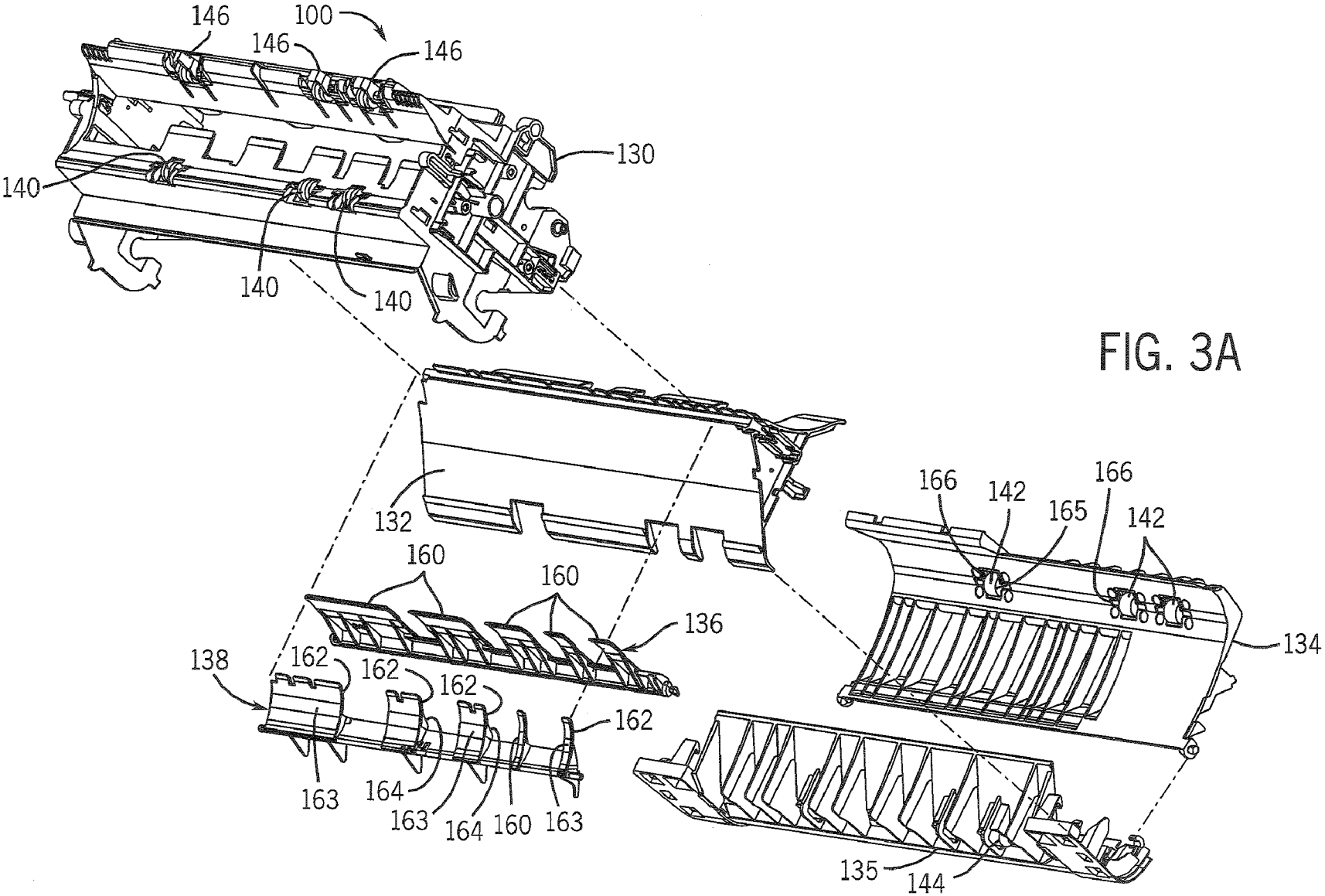
FIG. 3A is an exploded perspective view of a body of the accessory of FIG. 1 according to one exemplary embodiment.

As shown by FIGS. 3 and 3A, body 100 generally includes rear guide 130, inner guide 132, top guide 134, bottom guide 135, flip guide 136, flap guide 138, roller assemblies 140, 142, 144, 146 and covers 147 (shown in FIG. 2). Rear guide 130 serves as a major structure for body 100 in that the majority of the remaining parts and subassemblies of accessory 14 attach to rear guide 130. Rear guide 130 rotatably supports rollers 106 and 108. Rear guide 130 cooperates with inner guide 132 to form portions 118, 120, 122 and 124 of duplex path 116.

Inner guide 132 is coupled to rear guide 130 and is configured to cooperate with rear guide 130 to form portions of media duplex path 116. Inner guide 132 is generally positioned between rear guide 130 and top guide 134. Inner guide 132 cooperates with top guide 134 to form intermediate portion 126 of path 116. Inner guide 132 diverts media from top guide 134 over rollers 106 and 108, guides media from tray 110 into main unit 12, guides media from bottom tray 150 to media path 116 and towards main unit 12. Inner guide includes a squaring bar 152 for de-skewing media.

Figure 4:
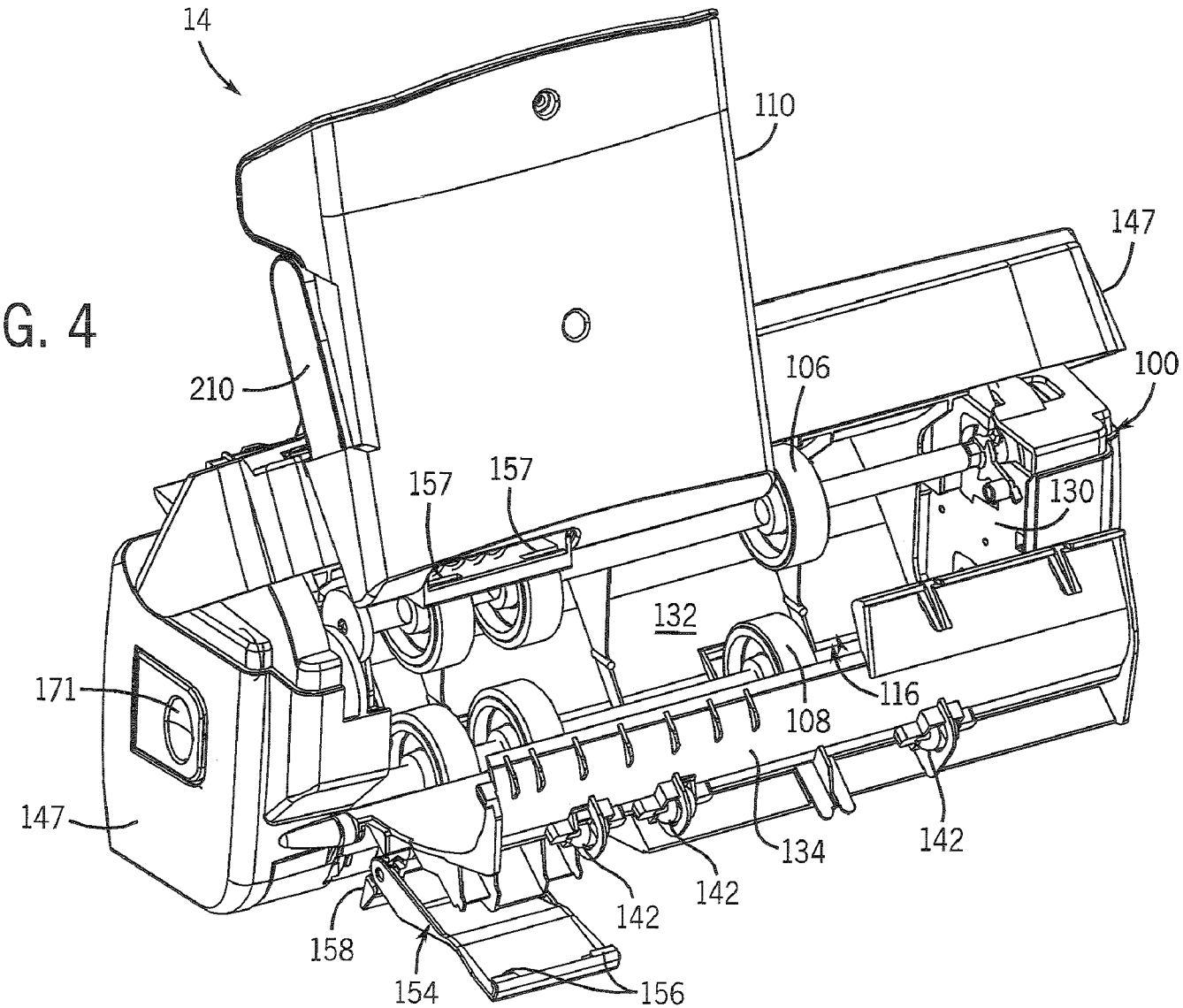
FIG. 4 is a rear perspective view of the accessory of FIG. 2 illustrating portions of the accessory in opened positions according to one exemplary embodiment.

Top guide 134 comprises one or more structures configured to guide the media from roller 106 to roller 108 and to form intermediate portion 126 of duplex path 116. In addition, in the embodiment illustrated, top guide 134 also serves as a cover. In particular, as shown by FIG. 4, media input tray 110 is pivotally coupled to body 100 such that media input tray 110 pivots in a counterclockwise direction (as seen in FIG. 4). Top guide 134 is pivotally coupled to body 100 which enables top guide 134 to pivot in a clockwise direction (as seen in FIG. 4) away from portion 126 of duplex path 116. Pivotal movement of top guide 134 away from duplex path 116 exposes rollers 106 and 108 and portion 126 of duplex path 116 to facilitate a clean out of media jams along duplex path 116.

In the particular embodiment illustrated, top guide 134 is retained in a raised or closed position by a latch mechanism 154 which may be actuated without the use of tools. Latch mechanism 154 further secures tray 110 in an operating position. As shown by FIG. 4, latch mechanism 154 includes hooks 156 which may be positioned within corresponding recesses 157 and retained or released by actuation of over center actuation mechanism 158. In other embodiments, top guide 134 may be retained in the closed position by other fastening or connection mechanisms.

Bottom guide 135 comprises an elongate structure configured to partially encircle a portion of roller 108. Bottom guide 135 further cooperates with rear guide 130 to form media feed path 159 which is in communication with duplex path 116. Media feed path 159 enables media from a lower media source such as a lower input tray 150 (schematically shown) to be input into main unit 12. Bottom guide 135 additionally pivotally supports top guide 134.

Flip guide 136 comprises one or more structures positioned adjacent to portion 120 of duplex path 116 and configured to direct media exiting duplex path 116 into main unit 12. In the particular example shown, flip guide 136 comprises a single elongate structure having multiple fingers 160 which interact with media. Flip guide 136 is pivotally coupled to inner guide 132 and pivots about axis 161 to provide a smooth hand off of media to main unit 12.

Flap guide 138 comprises one or more structures adjacent to portion 118 of duplex path 116 and configured to guide media entering duplex path 116. In the particular example shown, flap guide 138 comprises a single elongate structure including multiple flaps 162 which project upward towards fingers 160 and which have a lower concave surface 163 which is configured to smoothly transition media being moved about pick roller 44 (shown in FIG. 3). Each flap 162 has an upper surface 164 opposite the lower surface of a corresponding finger 160 so as to guide media passing between fingers 160 and flaps 162. Flap guide 138 is pivotally coupled to rear guide 130 so as to pivot between a tray exit position in which guide 138 provides a substantially smooth media path for media input from tray 110 into main unit 12 and a duplexer exit position in which guide 138 provides a substantially smooth media path for media exiting duplex path 116 and entering main unit 12.

As shown by FIGS. 2, 3A and 5, roller assemblies 140, 142 and 144 are substantially identical to one another in that each roller assembly 140, 142, 144 includes a roller 165 rotatably supported by one or more roller springs 166 (shown in FIG. 3A), which serve as axles for each roller 165. Roller assemblies 140 are rotatably coupled to rear guide 130 and extend below guides 136. Roller assemblies 140 are configured to generally extend opposite to rollers 44 of media feed 26 of main unit 12 when accessory 14 is connected to main unit 12. Roller assemblies 140 serve as pinch rollers for pinching media against rollers 44 as media is rotatably driven about rollers, 44 and below guides 136.

As shown by FIGS. 3A and 4, roller assemblies 142 and 144 are generally located opposite to rollers 106 and 108, respectively. Roller assemblies 142 are rotatably coupled to top guide 134. Roller assemblies 144 are rotatably coupled to bottom guide 135. Roller assemblies 142 and 144 facilitate movement of media within duplex path 116 about rollers 106 and 108.

Roller assemblies 146 are rotatably coupled to rear guide 130 between and above guides 138. Roller assemblies 146 facilitate movement of media between rear guide 130 and guides 138.

As further shown by FIG. 5, roller assemblies 146 additionally include roller sleds 168. Roller sleds 168 straddle rollers 165 of roller assemblies 146 and serve as guards to prevent media from crashing into rollers 165 of roller assemblies 146 when media is moving backward into duplex path 116. Roller sleds 168 provide a ramp surface that guides the media over the remainder of roller assemblies 146 into duplex path 116, allowing the media to transition around rollers 106 and 108 and to move smoothly within accessory 14.

Because body 100 provides a duplex path 116 which extends below the media input path from tray 110, accessory 14 is compact. Because body 100 is configured such that portion 118 of duplex path 116 also serves as a media input path for media being input to main unit 12 from tray 110, accessory 14 may operate with less parts and is also more compact. Although body 100 is illustrated and described as including rear guide 130, inner guide 132, top guide 134, flip guide 136 and flap guide 138, body 100 may alternatively include a greater or fewer number of such guides having similar or dissimilar configurations.

Figure 2A:
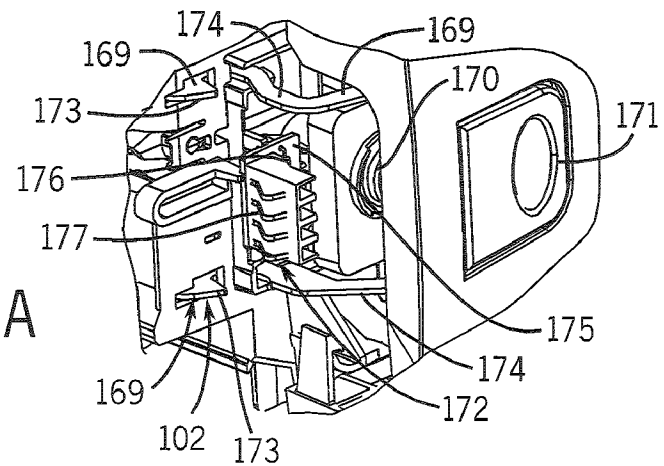
FIG. 2A is an enlarged fragmentary perspective view of a latch mechanism of the accessory of FIG. 2 according to one exemplary embodiment.

Latch mechanisms 102 comprise retainers configured to releasably attach or connect accessory 14 to main unit 12. As shown by FIG. 2, accessory 14 connects to main unit 12 through opening 40 at a rear 42 of main unit 12. Portions of rear guide 130 and accessory transmission 104 are received within main unit 12 through opening 40. Latch mechanisms 102 are located on opposite sides of accessory 14. As shown by FIG. 2A, latch mechanisms 102 each include hook or wedge 169, spring 170, actuator 171 and connection indicator 172. Hooks 169 each comprise elongate rigid members having tips 173 and arms 174. Arms 174 extend from tips 173 and to engagement with spring 170. Tips 173 and arms 174 move between an extended position (shown) and a retracted position. Spring 170 engages a bar (not shown) interconnecting arms 174 and resiliently biases arms 174 and tips 173 to the extended position shown. Actuator 171 comprises a button formed along side cover 147 and configured to be pivoted so as to manually depress arms 174 against the bias of spring 170 to move tips 173 to the retracted position.

Connection indicator 172 comprises a mechanism configured to indicate the connection of accessory 14 to main unit 12 to controller 30. In the particular embodiment illustrated, indicator 172 includes a circuit board 175 carrying a resistor 176 which is in electrical communication with electrical contacts 177. Upon accessory 14 being connected to main unit 12, contacts 177 are brought into electrical contact with corresponding contacts (not shown) of main unit 12 which are in electrical contact with controller 30 to enable the connection of accessory 14 to be electrically detected by controller 30.

During connection of accessory to main unit 12, tips 173 engage corresponding mounting portions 184 of main unit 12 and are depressed or moved to their retracted positions against the bias of spring 170. After full insertion, spring 170 urges tips 173 to their extended positions within corresponding openings 186 in mounting portions 184. To disconnect accessory 14, actuators 171 are depressed, moving tips 173 to their retracted position against the bias of springs 170 and withdrawing tips 173 from openings 186. Thereafter, accessory 14 may be pulled from opening 40 of main unit 12.

In alternative embodiments, various other latch mechanisms or retaining means may be employed to retain accessory 14 relative to main unit 12. In some embodiments, connection indicator 172 may be omitted or may be provided with alternative electronics or mechanisms configured to indicate or communicate the complete connection of accessory 14 to main unit 12. In the particular example illustrated, only one of latch mechanisms 102 includes connection indicator 172. In other embodiments, both latch mechanisms 102 may alternatively include connection indicator 172.

Accessory transmission 104 includes a series of members configured to selectively deliver power or torque from transmission 24 of main unit 12 to rollers 106, 108 and media driving mechanism 112. In the particular example shown, transmission 104 includes a connection gear 189 which meshes with an output gear 190 of transmission 24 when accessory 14 is connected to main unit 12. As will be described in greater detail hereafter, input gear 189 may be selectively and operably coupled to at least one of rollers 106, 108 and media driving mechanism 112 via a series of gears, clutches and other mechanisms. Because transmission 104 meshes with transmission 24 upon connection of accessory 14 to main unit 12, accessory 14 may derive all of its needed power or torque from main unit 12 without additional motors or other power sources associated with accessory 14. As a result, accessory 14 is more compact, is less complex and is less expensive to manufacture.

Rollers 106, 108 are rotatably supported adjacent to duplex path 116. In the particular example shown, both rollers 106 and 108 are rotatably driven by torque transmitted via transmission 104 from main unit 12. Rollers 106 and 108 are configured to engage media during duplexing to move media along duplex path 116 and so as to overturn media. In the particular embodiment shown in FIG. 3, media is overturned as it is being rotated about the rotational axes of rollers 106 and 108. In other embodiments, rollers 106 and 108 may alternatively be replaced with other devices configured to grasp and to move media along duplex path 116. For example, in other embodiments, rollers 106 and 108 may be replaced with one or more endless belts rotatably supported about a plurality of axes.

Media input tray 110 comprises an arrangement of structures configured to store and support a single sheet or a stack of sheets of media for being fed or supplied to main unit 12. In the particular example shown, tray 110 supports sheets of print media in an inclined orientation with lower edges of such sheets facing in a downward direction. Media input tray 110 is mounted to body 100 at a rear of body 100 and generally includes floor 191, back 192, lateral enclosures 194, 196 and width adjust 198. Floor 191 serves as a base or foundation for tray 110 and is arranged so as to contact a lower edge of a sheet or sheets of media stored within tray 110. As shown by FIG. 3, floor 191 is inclined relative to horizontal and relative to back 192. The inclination of floor 191 provides a transition surface for movement of a sheet of media into media feed path 200 (which is partially coextensive with portion 118 of duplex path 116) by media driving mechanism 112 and media driving rollers 202 which cooperate with pinch rollers 204. In other embodiments, floor 191 may extend at other orientations.

Back 192 comprises one or more members configured to support a stack of media upon floor 191 in an inclined orientation. In particular, back 192 is configured to bear against and support a rear face of a rearward most sheet of a stack of media. In the particular example illustrated, back 192 includes a compressible portion 206 extending generally opposite to a portion of media driving mechanism 112. Portion 206 is formed from a compressible material such as cork. Portion 206 cooperates with an opposite portion of driving mechanism 112 to facilitate picking of individual sheets of media when the total number of sheets of media are reduced in number. In other embodiments, portion 206 may be omitted.

Lateral enclosures 194, 196 extend along opposite edges of back 192. Lateral enclosure 194 is configured to provide a hard stop for width adjuster 198. Enclosure 196 is configured to provide a registration surface for the lateral edges of a stack of media stored within tray 110. Width adjuster 198 comprises an elongate rigid panel providing a surface which is movable towards and away from lateral enclosure 196. Width adjuster 198 enables tray 110 to engage both side edges of a stack of media having different widths. In the particular example illustrated, tray 110 is specifically configured to hold smaller size media such as 4 inch by 6 inch photo media, postcards, L-sized media and the like. In the particular example shown, width adjuster 198 is configured to be spaced from an inner registration surface of lateral enclosure 196 by a maximum distance of five inches. In other embodiments, tray 110 may be configured to alternatively store other sizes and types of media.

Media drive mechanism 112 comprises a mechanism configured to initially pick a sheet of media from tray 110 and move the picked media towards roller 202 and into media feed path 200. Media drive mechanism 112 generally includes linkage or arm 210, media driver 212 and media driver cover 214. Arm 210 generally comprises an elongate structure or combination of structures extending from a lower portion of tray 110 so as to support media driver 212 opposite back 192. Arm 210 further supports a portion of transmission 104 used for transmitting power to drive member 212. Arm 210 is pivotally coupled to tray 110 so as to pivot between a loading position in which media driver 212 and cover 214 are spaced from back 192 for loading media in tray 110 and a picking position in which media driver 212 is positioned against a stack media stored within tray 110.

In the particular embodiment illustrated, arm 210 is operably coupled to a deslouch system 216 associated with floor 191. Deslouch system 216 includes a plurality of members having high friction surfaces which are pivoted or otherwise elevated above floor 191 in response to arm 210 being pivoted to the loading position. The high friction surfaces grip or engage the lower edges of media within tray 110 to prevent the media from fanning. Upon the supply of torque to media driver 212, the high friction members are automatically lowered to below floor 191 to facilitate picking of a sheet of media and the movement of a sheet of media into media feed path 200. In other embodiments, accessory 14 may omit the deslouch system.

Media driver 212 comprises a member to be rotatably driven while in engagement with a frontward most sheet of a stack of media within tray 110 so as to pick the sheet of media for movement from tray 110. In the particular embodiment illustrated, media driver 212 comprises a pick tire or roller configured to be rotatably driven by torque transmitted through transmission 104. In other embodiments, media driver 212 may alternatively comprise other pick mechanisms such as one or more belts rotatably driven about a plurality of axes.

Pick tire cover 214 comprises a member extending partially about media driver 212 and configured to provide a handle for enabling a user to manually move arm 210 towards the loading position. In the particular example shown, cover 214 additionally bears against a frontward most sheet of a stack of media within tray 110. In other embodiments, cover 214 may alternatively not engage media or may be omitted.

FIGS. 5-9 illustrate accessory 14 in greater detail. In particular, FIG. 5 illustrates accessory 14 with covers 147 removed. FIG. 6 illustrates accessory 14 with tray 110 and top guide 134 removed to illustrate rollers 106 and 202. FIG. 6 further illustrates portions of arm 210 removed to illustrate portions of transmission 104.

As shown by FIG. 6, transmission 104 additionally includes dial mechanism 228 including input gear 189, intermediate gear 230 and swing arm assembly 232, duplex power train 236, media drive power train 238 and swing arm assembly 240. Intermediate gear 230, swing arm assembly 232, duplex power train 236, media drive power train 238 and swing arm assembly 240 form a collective power train for selectively transmitting torque from input gear 189 to duplex rollers 106, 108, media driver 212, intermediate gears 230 and deslouch system 216 (shown in FIG. 1). Intermediate gear 230 comprises a gear in rotatable meshable engagement between input gear 189 and swing arm assembly 232. Gear 230 transmits torque from input gear 189 to swing arm assembly 232.

Figure 9:
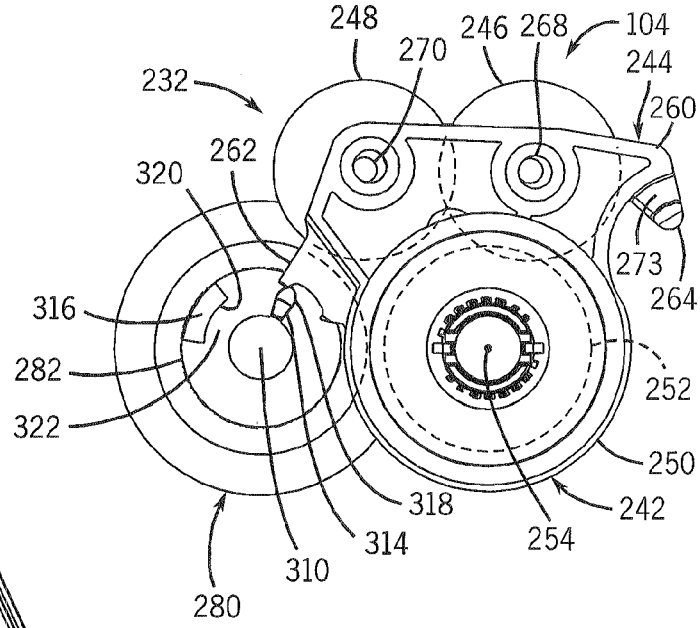
FIG. 9 is a side elevational view of a swing arm assembly and a portion of a duplex power train including a swing arm interaction hub according to one exemplary embodiment.

Swing arm assembly 232 selectively transmits torque from intermediate gear 230 to duplex power train 236 of transmission 104. As shown by FIG. 9, swing arm assembly 232 includes cluster gear 242, swing arm 244 and gears 246, 248. Cluster gear 242 includes an outer gear 250 and an inner gear 252 which rotate together about a common axis. Outer gear 250 is in meshing engagement with intermediate gear 230. Inner gear 252 is in meshing engagement with gear 246. Cluster gear 242 is releasably clutched to swing arm 244 between outer gear 250 and inner gear 252 so as to rotate with cluster gear 242 about axis 254 when swing arm 244 and gears 246, 248 are out of engagement with duplex power train 236 or when swing arm 244 and gears 246, 248 are being rotatably driven about axis 254 out of engagement with duplex power train 236. At the same time, when swing arm 244 or gears 246, 248 are in engagement with duplex power train 236, cluster gear 242 may be rotatably driven about axis 254 relative to swing arm 244 as swing arm 244 remains stationary. In the particular example illustrated, cluster gear 242 is releasably clutched to swing-arm 244 by one or more springs (not shown) held by fasteners and urging swing arm 244 into frictional engagement with cluster gear 242. In other embodiments, cluster gear 242 may be releasably clutched to swing arm 244 in other fashions.

As shown by FIGS. 7 and 8, swing arm 244, sometimes referred to as a gear carrier, comprises a single integral unitary body formed out of a relatively rigid material such as plastic or metal. Swing arm 244 includes hub 258, gear support 260, stop neutral 262 and hook 264. Hub 258 comprises that portion of swing arm 244 which is releasably clutched to cluster gear 242. Hub 258 includes a central opening 266 through which outer gear 250 and inner gear 252 are connected to one another on opposite sides of hub 258. Gear support 260 radially projects from hub 258 and includes apertures 268 and 270 for rotatably supporting gears 246 and 248, respectively. Stop neutral 262 comprises a projection extending from support 260 and forming a notch or recess 272. As will be described in greater detail hereafter, recess 272 provides a surface by which swing arm 244 engages or abuts a selectively positioned portion of duplex portion 236 to space gear 248 from engagement with duplex portion 236 and to maintain transmission 104 in a neutral mode.

Hook 264 projects from an opposite side of support 260 as stop neutral 262. As will be described in greater detail hereafter, hook 264 is configured to be rotated about axis 254 into various engagement positions with duplex portion 236. In one position, hook 264 enables swing arm 244 to be held in place as gear 246 is in engagement with duplex portion 236 and while cluster gear 242 is rotated in a counter-clockwise direction as seen in FIG. 18 to move swing arm assembly 240 and to transmit torque to media drive portion 238 of transmission 104.

As shown by FIG. 9, gear 246 comprises a gear rotatably coupled to support 260 of swing arm 244 via aperture 268. Gear 248 comprises a gear rotatably coupled to support 260 of swing arm 244 via opening 270. Gear 248 is in meshing engagement with gear 246. Gear 246 is in meshing engagement with inner gear 252 of cluster gear 242.

Figure 13:
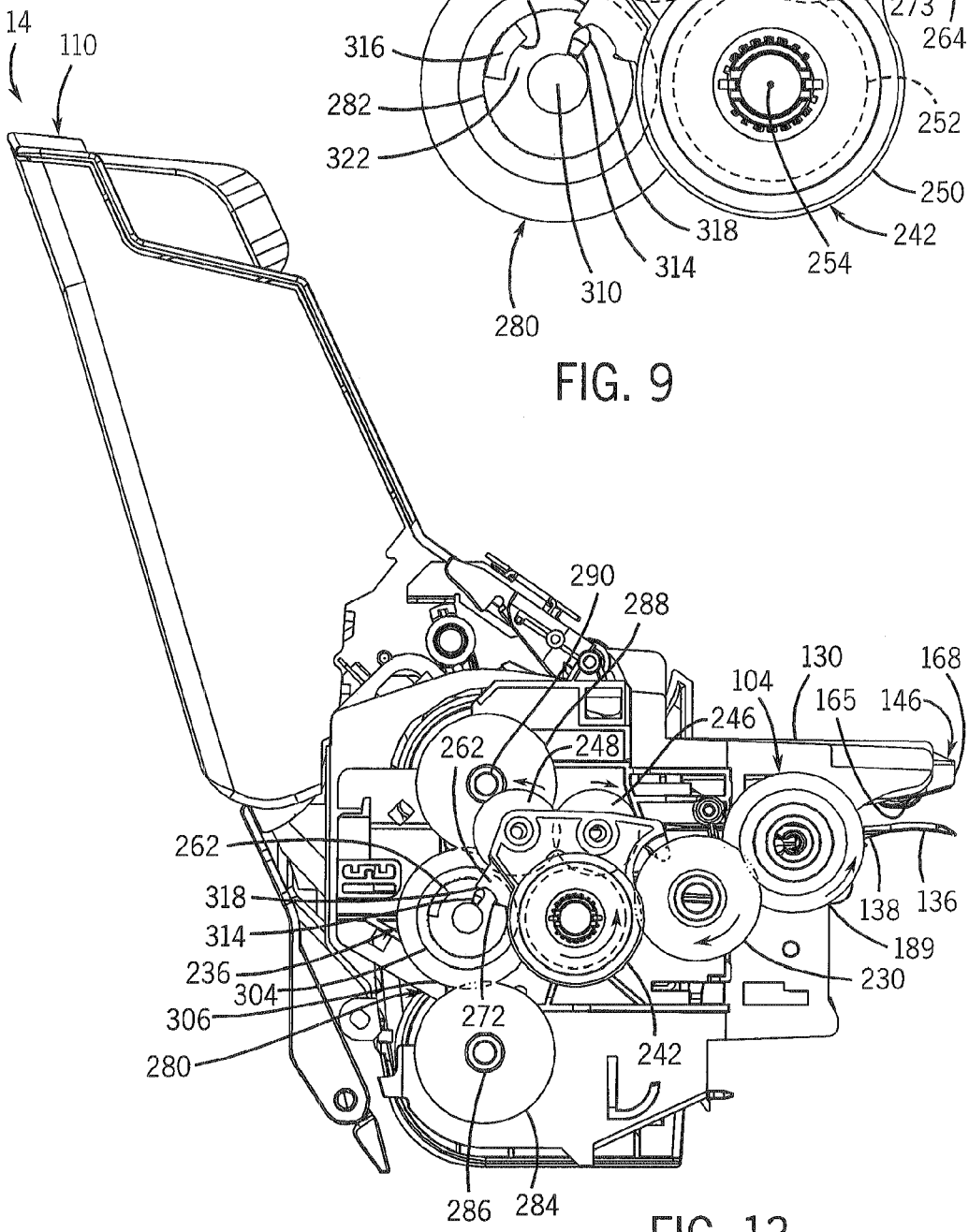
FIG. 13 is a side elevational view of the accessory of FIG. 1 with portions removed for purposes of illustration according to one exemplary embodiment.

Duplex power train 236 comprises that portion of transmission 104 configured to transmit torque from swing arm assembly 232 to rollers 106, 108 and to swing arm assembly 240. Duplex portion 236 includes cluster gear 280, swing arm interaction hub 282, lower gear 284, lower shaft 286 (shown in FIG. 13), upper gear 288, upper shaft 290, gears 294, 296 and cluster gear 292 (shown in FIG. 10). Cluster gear 280 is located between gears 284 and 288. Cluster gear 280 includes inner gear 304 and outer gear 306. Inner gear 304 includes teeth which are configured to be meshed with the teeth of either gear 248 or gear 246, depending upon the position of swing arm 244. Outer gear 306 is fixed to inner gear 304 and is in meshing engagement with each of gears 284 and 288 as shown in FIG. 13.

Carrier interaction hub 282 interacts with swing arm 244 during neutral and pick modes.

As shown in FIG. 11, hub 282 includes two opposing portions 324, 326. Portion 324 is releasably clutched to cluster gear 280 so as to rotate with cluster gear 280 about axis 310 and so as to enable cluster gear 280 to rotate relative to hub 282 about axis 310 when hub 282 is in engagement with swing arm 244. Portion 324 of hub 282 is releasably clutched to cluster gear 280 by a spring (not shown) held by a fastener against one of hub 282 and gear 280 so as to urge hub 282 and gear 280 into frictional engagement. In other embodiments, other clutching mechanisms may be used to releasably clutch portion 324 to cluster gear 280.

Portion 324 includes projection 314 and finger 315 while portion 326 includes bar 316 and groove 317. Projection 314 projects from a remainder of hub 282 and provides a surface 318 configured to abut or contact a surface of recess 272 of neutral stop 262 when swing arm assembly 232 is in the neutral position. Projection 314 is further configured such that when surface 318 contacts or abuts surface 272, gear 248 is spaced from gear 304 such that torque is not transmitted to duplex portion 236 of transmission 104, to rollers 106, 108, to media drive portion 238 of transmission 104 or to media driver 212. Finger 315 projects further from projection 314 and is configured to interact with groove 317 of portion 326 as will be described in greater detail hereafter.

Portion 326 extends opposite portion 324 such that groove 317 receives finger 315. Groove 317 includes opposite ends 319 and 321. Portion 326 is clutched along axis 310 by a spring such that portion 326 is generally static unless being rotated by rotation of finger 315 of portion 324 against groove end 321.

Bar 316 projects from a portion 326 of hub 282 to provide a surface 320 adjacent an opening, channel or slot 322 sized and located to receive hook 264 when swing arm assembly 232 has been moved to the pick position for transmitting torque to media driver 212. As shown by FIG. 12, portions 324 and 326 are spaced by a gap sufficient to enable hook 264 to pass between portions 324 and 326 with the channel or recess 273 or hook 264 receiving bar 316. In other embodiments, hub 282 may have other configurations.

Figure 10:
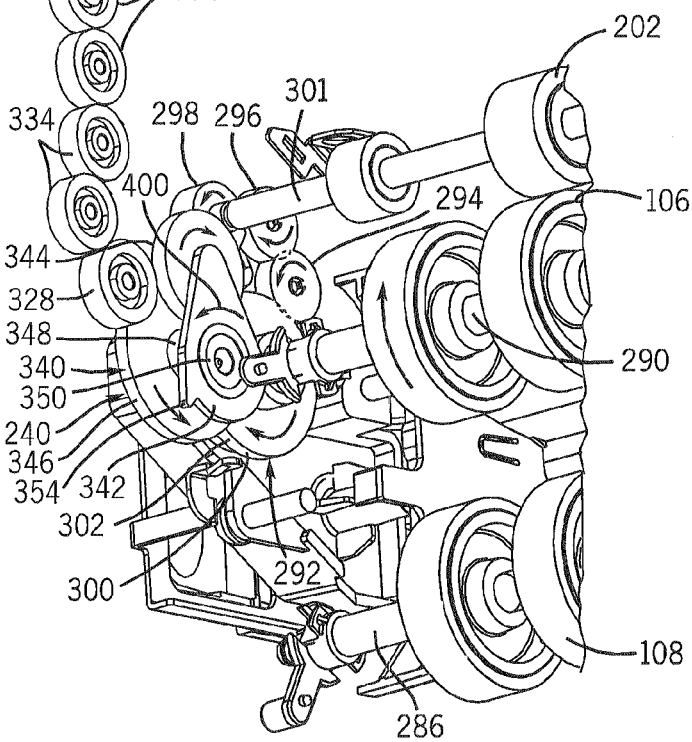
FIG. 10 is a fragmentary rear perspective view of the accessory of FIG. 2 with portions removed for purposes of illustration according to one exemplary embodiment.

Gears 284 and 288 are fixed to shafts 286 and 290, respectively, and are rotatably supported by rear guide 230 which serves as a frame for rotatably supporting shafts 286 and 290. As shown by FIG. 10, shaft 286 is coupled to rollers 108. Shaft 290 is coupled to rollers 106 and is further coupled to gear 292 such that rotation of shaft 290 results in gear 292 being rotated.

Gear 292 comprises a cluster gear which includes outer gear 300 and inner gear 302. Outer gear 300 comprises a gear in meshing engagement with gear 294. Gear 294 comprises a gear rotatably supported in meshing engagement with gear 296. Gear 296 comprises a gear rotatably supported in meshing engagement with gear 298. Gear 298 is coupled to intermediate shaft 301 which supports and rotatably drives intermediate rollers 202 at an appropriate torque and speed. Inner gear 302 comprises a gear in operable engagement with swing arm assembly 240.

Figure 19:
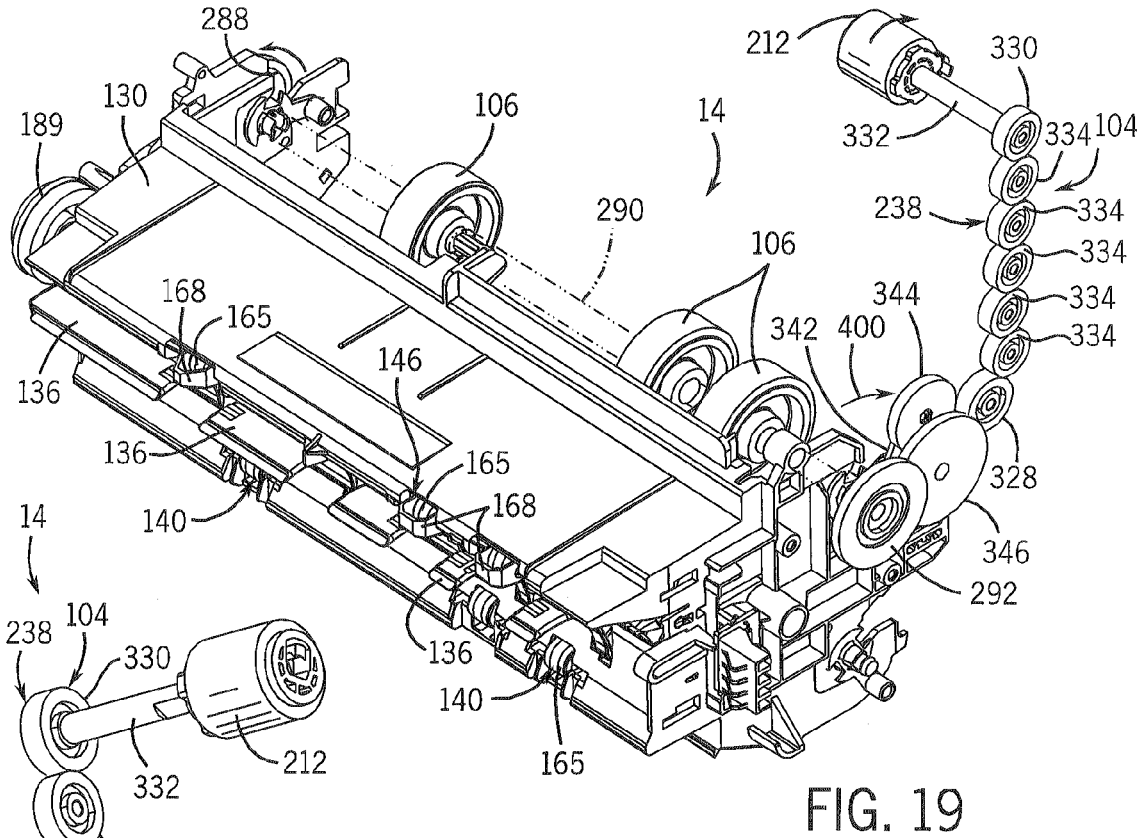
FIG. 19 is top perspective view of the accessory of FIG. 2 with portions removed for purposes of illustrating the accessory in a paper pick mode according to one exemplary embodiment.

Media drive power train 238 is configured to transmit torque to media driver 212. As shown by FIG. 19, media drive power train 238 of transmission 104 includes an input gear 328, an output gear 330 connected to a shaft 332 that is connected to drive member 212 and a plurality of intermediate gears 334 between gear 328 and gear 330, forming a gear train therebetween. Each of gears 328, 330 and 334 are rotatably supported by arm 210 (shown in FIG. 2). Although media drive portion 238 is illustrated as including a multitude of gears forming a gear train, media drive power train 238 may alternatively include a greater or fewer number of such gears or may include other means for transmitting torque from input gear 328 to shaft 332 and media driver 212 such as belt and pulley arrangements, chain and sprocket arrangements, toothed belt and toothed sprocket arrangements and the like.

Swing arm assembly 240 comprises a series of components configured to selectively transmit torque to media drive power train 238 of transmission 104. Swing arm assembly 240 generally includes cluster gear 340, swing arm 342 and idler gear 344. Cluster gear 340 includes outer gear 346 and inner gear 348. Outer gear 346 comprises a gear rotatably supported in meshing engagement with inner gear 302 of cluster gear 292. Inner gear 348 comprises a gear fixed to outer gear 346 and in meshing engagement with idler gear 344. Inner gear 348 additionally includes an axially extending cylindrical axle portion 350 about which swing arm 342 is free to rotate.

Swing arm 342 comprises an elongate member having a central portion secured to axle portion 350 so as to freely rotate relative to axle portion 350 and having an end portion releasably clutched to idler gear 344 such that torque applied to idler gear 344 by inner gear 348 rotates idler gear 344 and swing arm 342 about axle portion 350 together in substantial unison until further rotation of swing arm 342 about axle portion 350 is prevented. Discontinuance of the rotation of swing arm 342 about axle portion 350 results in idler gear 342 continuing to rotate relative to swing arm 342. Rotation of swing arm 342 about axle portion 350 is discontinued when idler gear 344 is brought into engagement with input gear 328 during counter-clockwise rotation of swing arm 342 about axle portion 350 (as seen in FIG. 10) or when projection 354 of swing arm 342 engages a portion of a stationary housing or chassis of accessory 14, such as top guide 134, during counter-clockwise rotation of swing arm 342 about axle portion 350 (as seen in FIG. 10).

In the particular embodiment illustrated, idler gear 344 is releasably clutched to swing arm 342 by a compression spring held against and urging idler gear 344 into frictional engagement with swing arm 342. In other embodiments, idler gear 344 may be releasably clutched to swing arm 342 by other clutching methods. Because idler gear 344 is being rotatably driven at a relatively lower speed and greater torque as compared to inner gear 348, torque and power requirements are reduced. In other embodiments, idler gear 344 may alternatively freely rotate relative to swing arm 342 while axle portion 350 is releasably clutched to swing arm 342.

FIGS. 13-19 illustrate accessory 14 operating in a neutral mode, a duplexing/feeding mode and a media pick mode. In the neutral mode, rollers 106, 108, media drive portion 236, media driver 212, and media drive power train 238 (shown in FIG. 6) are not driven. In particular, gears 246 and 248 are simply idled rather than being positioned in engagement with gear 304. As a result, when accessory 14 is mounted to main unit 12, but is not being utilized, less power is consumed.

Figure 14:
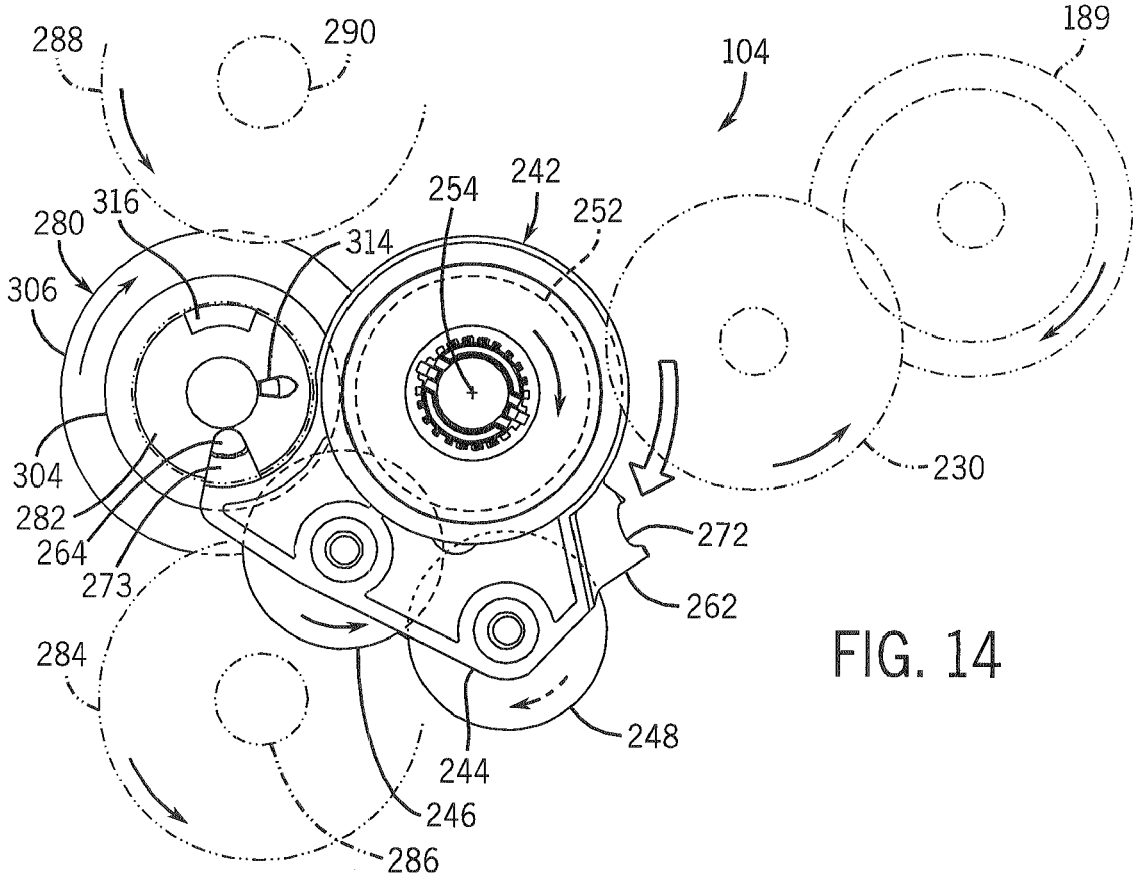
FIG. 14 is side elevational view illustrating the swing arm assembly of FIG. 9 in a first position relative to the duplex power train of FIG. 9 according to one exemplary embodiment.
Figure 15:
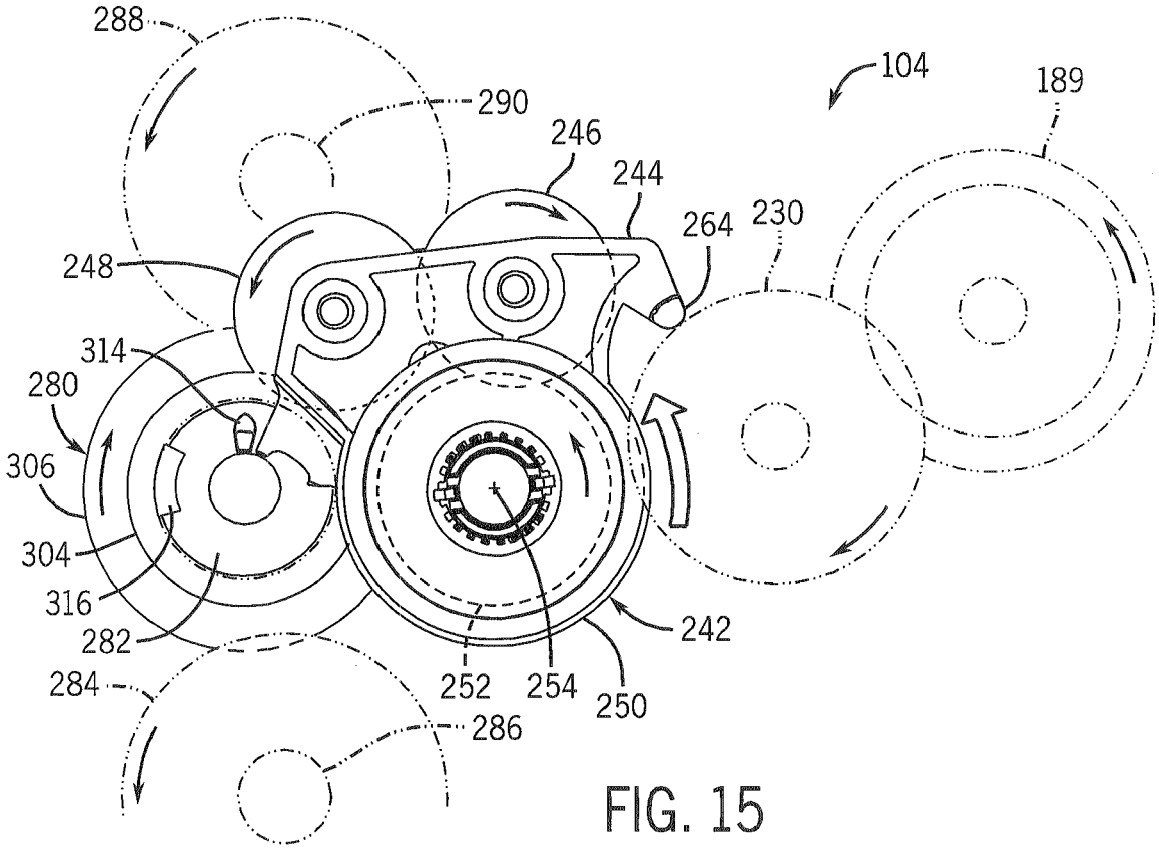
FIG. 15 is a side elevational view of the swing arm assembly of FIG. 14 in a second position with respect to the duplex power train of FIG. 14 according to one exemplary embodiment.

To actuate transmission to the neutral mode, controller 30 generates control signals causing motor 22 to drive main unit transmission 24 (shown in FIG. 3) which is engagement with input gear 189 of accessory transmission 104 so as to further drive input gear 189, gear 230 and gear 242 in the directions indicated by the arrows shown in FIG. 15. This results in swing arm 244 being rotated about axis 254 so as to position gear 248 in engagement with gear 304. This further results in gear 280 being rotatably driven in a clockwise direction. The rotation of gear 280 causes portion 324 of hub 282 which is clutched to it, to move along with it in clockwise rotation, until portion 314 hits the side of stop neutral 262 of swing arm 244. Further rotation of gear 280 does not cause any movement of hub 282. Swing arm 244 is subsequently driven in the clockwise direction, causing gear 246 to mesh with gear 304 as seen in FIG. 14. This drags hub 282 for a slight distance, when the move stops. The positioning of swing arm 244 and of hub 282 is detected or known to controller 30 by means of an encoder associated with motor 22 which transmits position signals to controller 30. In other embodiments, the encoder may alternatively be associated with transmission 24 or transmission 104. In other embodiments, the positioning of swing arm 244 and/or the positioning of hub 282 may be detected and communicated to controller 30 by various other means such as optical sensors, magnetic sensors and the like.

Once projection 314 is in the position shown in FIG. 13, controller 30 generates control signals causing motor 22 to drive transmission 24 (shown in FIG. 1) in a direction such input gear 189, gear 230 and gear 242 is driven in the direction of the arrows shown in FIG. 13. This results in swing arm 244 being rotated in a counter-clockwise direction as seen in FIG. 13 to position surface 272 of stop neutral 262 against or in abutting contact with surface 318 of projection 314. Consequently, gear 248 is spaced from and out of engagement with gear 280 of duplex portion 236 of transmission 104. This neutral mode may be maintained until either the duplexing mode or the pick mode is desired.

Figure 16:
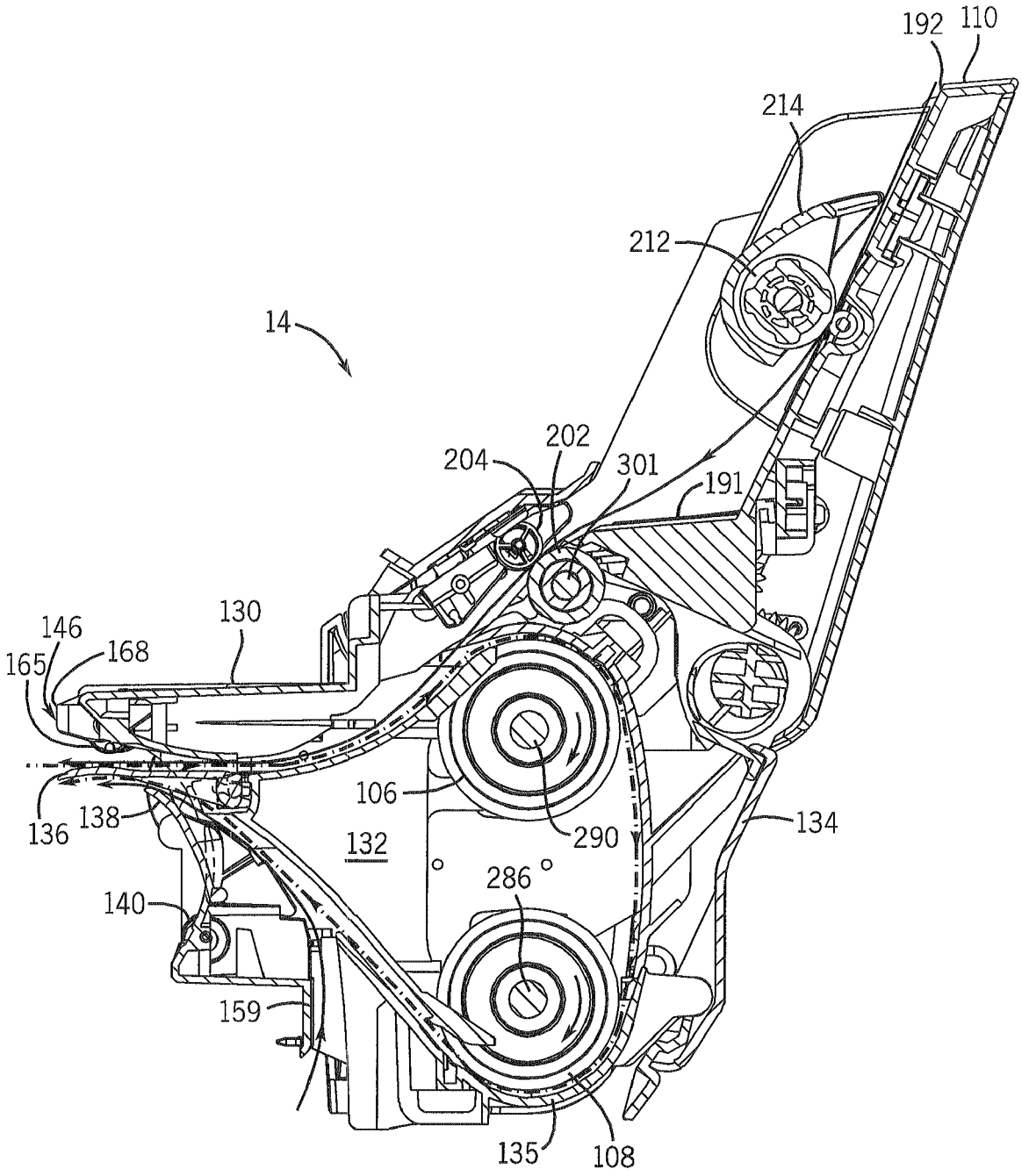
FIG. 16 is a sectional view of the accessory of FIG. 1 illustrating movement of media through accessory 14 during the supplying of media from accessory 14 and during the duplexing of media by accessory 14 according to one exemplary embodiment.

FIGS. 14 and 15 illustrate accessory 14 while transmission 104 is in the duplex mode. In particular, after main unit 12 has interacted with a first side of media, such as printing upon the first side of media, controller 30 generates control signals causing motor 22 to drive pick roller 44 of main unit 12 (shown in FIG. 3) in a reverse direction, moving media from main unit 12 into portion 118 of duplex path 116 of accessory 14. The media is fed into duplex path 116 by roller 44 until the entire sheet is contained within accessory 14 as determined by a flag or sensor (not shown). As roller 44 is driving media from main unit 12 into duplex path 116 of accessory 14, gears 189, 230 and 242 are driven in the direction indicated by the arrows shown in FIG. 14. As shown by FIG. 16, this results in rollers 106 and 108 being rotatably driven in a clockwise direction (as seen in FIG. 16). Once the media is completely received within duplex path 116 as indicated to controller 30 by a sensor, controller 30 (shown in FIG. 3) generates control signals causing motor 22 to drive roller 44 in a forward direction once again. This also results in gears 189, 230 and 242 being rotatably driven in the direction indicated by the arrows shown in FIG. 15. As a result, swing arm 244 rotates in a counter-clockwise direction (as seen in FIG. 15) to position gear 248 in meshing engagement with gear 280. As a result, torque is transmitted to rollers 106 and 108 to continue driving rollers 106 and 108 in the clockwise direction as seen in FIG. 16. This results in media within duplex path 116 to be driven about duplex path 116 and to be overturned prior to being once again being engaged by roller 44 of main unit 12 (shown in FIG. 3). Once the media is engaged by roller 44 of main unit 12, the media is moved through main unit 12 for printing or other interaction with the second side of the media.

Figure 20:
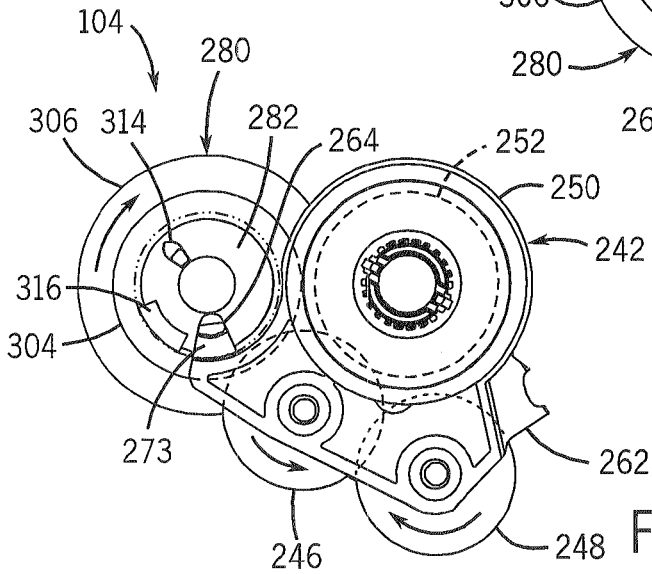
FIG. 20 is a side elevational view illustrating positioning of the swing arm assembly of FIG. 9 relative to the duplex power train of FIG. 9 at the end of a pick operation according to one exemplary embodiment.

FIGS. 10 and 16-19 illustrate transmission 104 and accessory 14 in a media pick mode. FIG. 20 illustrates the unlocking of transmission 104 from the pick mode and readying transmission 104 for a media feed mode as shown in FIG. 15. As shown by FIG. 17A, to actuate transmission 104 and accessory 14 to a media pick mode, controller 30 (shown in FIG. 3) generates control signals causing motor 22 to drive the main unit transmission 24 in a reverse direction which causes swing arm assembly 232 to be rotatably driven in a clockwise direction about axis 254 to bring gear 246 into engagement with gear 280. Gear 280 is rotatably driven until projection 314 is moved generally to the position shown in FIG. 17A. During rotation of gear 280, portion 324 of hub 282 is also rotatably driven in a clockwise direction with finger 315 engaging groove end 321 to also rotate portion 326 until projection 314 engages hook 264.

Figure 17A:
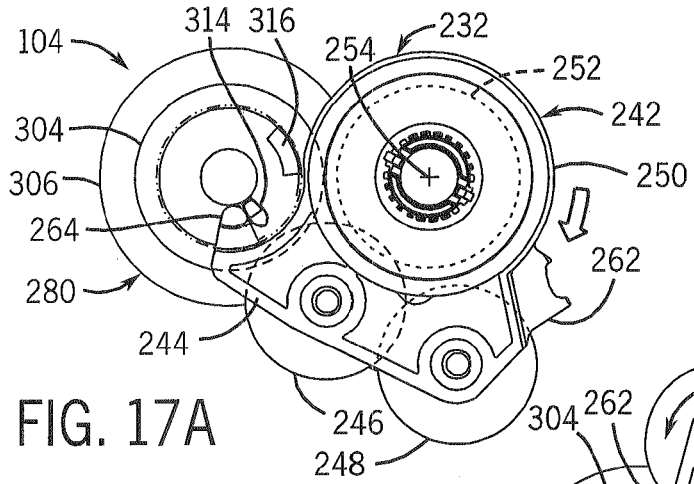
FIGS. 17A-17D illustrate the positioning of the swing arm assembly of FIG. 9 with respect to the duplex power train of FIG. 9 for picking paper from a media tray of the accessory of FIG. 2 according to one exemplary embodiment.
Figure 17B:
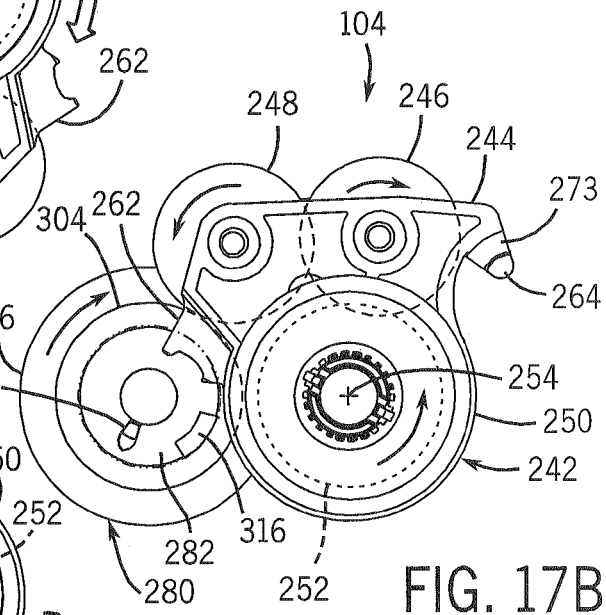

As shown in FIG. 17B, controller 30 generates control signals directing motor 22 to drive transmission 24 (shown in FIG. 3) in a forward direction such that swing assembly 232 rotates counter-clockwise (as seen in FIG. 17B) to position gear 248 in engagement with gear 280. Motor 22 continues to drive gear 248 in the direction indicated by the arrows shown in FIG. 17B to rotate gear 280 and hub 282 a slight distance in the clockwise direction (as seen in FIG. 17B) to reposition projection 314 such that hook 264 may be rotated about axis 254 to a position between projection 314 and bar 316.

Figure 17C:
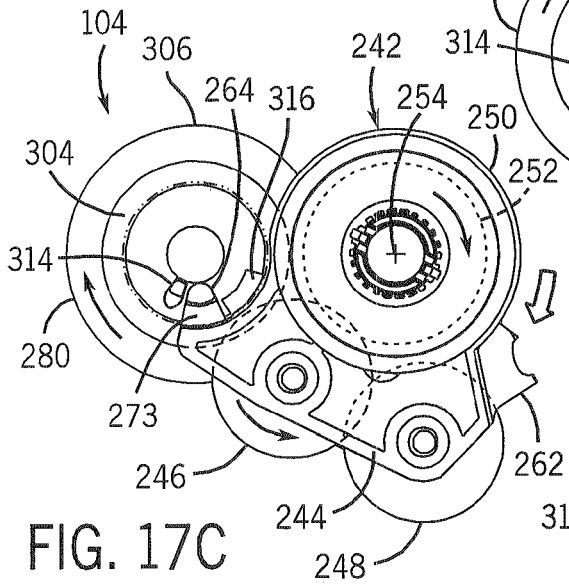

As shown by FIG. 17C, controller 30 generates control signals directing motor 22 to drive transmission 24 (shown in FIG. 3) once again in a reverse direction to rotate swing arm assembly 232 in a clockwise direction about axis 254 so as to position hook 264 between projection 314 and bar 316 and to position gear 246 into meshing engagement with gear 304. Therefore, motor 22 (shown in FIG. 3) continues to drive gear 246 and gear 280 in the directions indicated by the arrows shown in FIG. 17C to position bar 316 within channel 273 of hook 264 as shown in FIGS. 17D and 18.

Figure 17D:
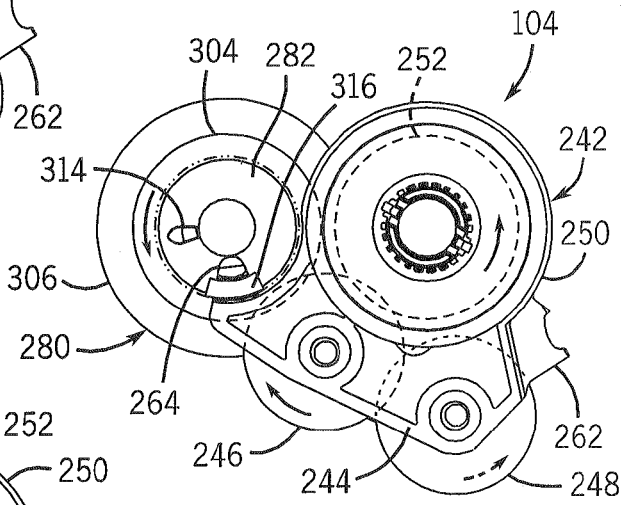

Once bar 316 and hook 264 are engaged as shown in FIGS. 17D and 18, controller 30 generates control signals directing motor 22 to drive transmission 24 (shown in FIG. 3) in a forward direction which results in gears 242, 246 and 248 being driven in the directions indicated by the arrows shown in FIGS. 17D and 18. As a result, gear 246 drives gear 280 in a counter-clockwise direction (as seen in FIGS. 17D and 18) relative to hub 282 which is held substantially stationary by the engagement of bar 316 with hook 264. The counter-clockwise rotation of gear 280 in FIG. 17D results in finger 315 sliding within groove 317 from end 321 towards end 319. However, finger 315 engages hook 264 prior to reaching end 319. As a result, portion 326 of hub 282 remains static with bar 316 captured by hook 264 during the counter-clockwise rotation of gear 280.

As shown by FIG. 18, the counter-clockwise rotation of gear 280 results in gears 284 and 288 being driven in a clockwise direction (as seen in FIG. 18). As shown by FIG. 10, clockwise rotation of gear 288 results in shaft 290 being rotated in the clockwise direction (as seen in FIG. 10) and results in gear 92 also being rotatably driven in the clockwise direction as seen in FIG. 10. Gear 302 of cluster gear 292 is driven in the clockwise direction so as to drive gears 346 and 348 in a counter-clockwise direction (as seen in FIG. 10). Gear 348 drives idler gear 344 in a clockwise direction. Because idler gear 344 is releasably clutched to swing arm 342, this results in swing arm 342 being rotated about axle portion 350 in the direction indicated by arrow 400 as shown in FIGS. 10 and 19 until idler gear 344 is brought into meshing engagement with input gear 328 of media drive train 238. Thereafter, gear 348 continues to drive idler gear 344 in a clockwise direction (as seen in FIG. 10) relative to swing arm 342 so as to supply torque to drive train 238. The torque is transmitted through gears 328, 334 and 330 to shaft 332 which rotatably drives media driver 212 to pick or otherwise move a sheet of media within tray 110 (shown in FIG. 5) and to move the sheet of media into engagement with intermediate rollers 202 which continue to drive the media through feed path 200 and through portion 118 of duplex path 116 into main unit 12.

Once the sheet of media being driven by intermediate rollers 202 has been disengaged from media driver 212 as indicated by one or more sensors or flags (not shown) transmitting signals to controller 30, the pick of further media sheets is discontinued by controller 30 generating control signals directing motor 22 to temporarily drive transmission 24 (shown in FIG. 3) in a reverse direction, causing gear 280 to be rotatably driven in a clockwise direction (as seen in FIG. 20) which also causes hub 282 to rotate with gear 280 and to withdraw bar 316 from slot 273 of hook 264. In particular, finger 315 is rotated and slid within groove 317 until contacting end 321. Once finger 315 is in contact with end 321, continued rotation of gear 280 and portion 324 results in portion 326 and its bar 316 also being rotated in a clockwise direction so as to be withdrawn from slot 273 of hook 264. Once bar 316 is withdrawn from hook 264, controller 30 generates control signals directing motor 22 to drive transmission 24 in the forward direction which results in swing arm assembly 240 rotating about axis 254 to the position shown in FIG. 15. Thereafter, motor 22 continues to drive transmission 24 in the forward direction such that intermediate rollers 202 continue to move the pick sheet of media towards and into main unit 12 until the sheet of media is engaged by pick roller 44 (shown in FIG. 3). Pick roller 44 continues to move the sheet of media within main unit 12 for interaction on a first side of the media. In the example shown, print device 28 prints upon the first side of media. Once printed upon, the sheet of media may be discharged through outlet opening 36 or may be duplexed as described above.

Although the aforementioned has been described with reference to example embodiments, workers skilled in the art will recognize that changes may be made in form and detail without departing from the spirit and scope of the disclosure. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements.

What is claimed is:

1. A media handling accessory configured to be releasably mounted to a main unit, the accessory comprising:

a first media input tray;

a duplex path having a U-turn portion through which media is overturned while within the accessory, wherein the duplex path is configured to receive media from the main unit, is configured to overturn the media in the accessory, and is configured to return overturned media to the main unit; and at least one guide forming a feed path extending from the first media input tray and configured to extend towards the main unit, the feed path extending above the duplex path.

2. The accessory of claim 1, wherein the duplex path is subjacent the tray.

3. The accessory of claim 1, wherein the tray includes a floor and a back inclined relative to the floor.

4. The accessory of claim 3, wherein the floor declines relative to horizontal from the back.

5. The accessory of claim 1 including a media driver opposite the first media input tray.

6. The method of claim 5, wherein the media driver is movable towards and away from the first media input tray.

7. The accessory of claim 1 including a first roller, wherein the duplex path at least partially encircles a rotational axis of the first roller.

8. The accessory of claim 7 including a second roller, wherein the duplex path at least partially encircles a rotational axis of the second roller.

9. The accessory of claim 7 including a guide forming at least a portion of the duplex path, wherein the guide is pivotal between a first position adjacent the duplex path and a second position exposing the first roller.

10. The accessory of claim 1 including a cover, wherein the cover is pivotal between a first position covering the duplex path and a second open position exposing the duplex path.

11. The accessory of claim 10, wherein the first media input tray is pivotal about a first axis and wherein the cover is pivotal about a second axis.

12. The accessory of claim 1, wherein the first media input tray forms a media stack volume distinct from the duplex path.

13. The accessory of claim 1 including:

a first media feed path extending from the first media input tray; and a second media feed path configured to communicate with a second tray.

14. The accessory of claim 1, wherein the feed path extends from the first media input tray to a printing device within the main unit.

15. The accessory of claim 1, wherein the first media input tray has a media storage volume having a maximum width of five inches.

16. The accessory of claim 1, wherein the duplex path is at least 11.69 inches long.

17. The accessory of claim 1 including a latch configured to releasably connect the accessory to a main unit.

18. The accessory of claim 1 including:

a media driver configured to move media; and a transmission operably coupled to the media driver and configured to receive torque from a main unit to which the accessory is releasably mounted.

19. The accessory of claim 1 including:

a first media driver configured to engage media within the first media input tray;

a second media driver configured to engage media along the duplex path; and a transmission operably coupled to the first media driver and the second media driver, wherein the transmission is configured to receive torque from a main unit to which the accessory is releasably mounted.

20. The accessory of claim 1, wherein the feed path is configured to connect to a second feed path extending into the main unit to a print device.

21. The accessory of claim 20, wherein a portion of the feed path is coextensive with a portion of the duplex path.

22. The system of claim 20, wherein a portion of the feed path is coextensive with a portion of the duplex path.

23. A media handling system comprising:

a main unit; and an accessory releasably mounted to the main unit, the accessory including:

a first media input tray;

a duplex path subjacent the first tray;

a first roller, wherein the duplex path at least partially encircles a rotational axis of the first roller; and a guide forming at least a portion of a feed path extending from the first media input tray and configured to extend towards a main unit, the feed path extending above the duplex path.

24. The system of claim 23, wherein the first media input tray includes a floor and a back inclined relative to the floor.

25. The system of claim 24, wherein the floor declines relative to horizontal from the back.

26. The system of claim 23 including a media driver opposite the first media input tray.

27. The system of claim 23 including a second roller, wherein the duplex path at least partially encircles a rotational axis of the second roller.

28. The system of claim 23 including a guide forming at least a portion of the duplex path, wherein the guide is pivotal between a first position adjacent the duplex path and a second position exposing the first roller.

29. The system of claim 23 including a cover adjacent the duplex path, wherein the cover is pivotal between a first position covering the duplex path and a second position exposing the duplex path.

30. The system of claim 29, wherein the first media input tray is pivotal about a first axis and wherein the cover is pivotal about a second axis.

31. The system of claim 23, wherein the first media input tray forms a media stack volume distinct from the duplex path.

32. The system of claim 23 including:

a first media feed path extending from the first media input tray; and a second media feed path configured to communicate with a second media input tray.

33. The system of claim 23, wherein the media feed path extends to a printing device within the main unit.

34. The system of claim 23, wherein the first media input tray has a media storage volume having a maximum width of five inches.

35. The system of claim 23, wherein the duplex path has a minimum length of at least 11.69 inches.

36. The system of claim 23, wherein the main unit includes a printing component.

37. The system of claim 23, wherein the accessory includes:

a media driver configured to move media; and a transmission operably coupled to the media driver and configured to receive torque from the main unit when the accessory is releasably mounted to the main unit.

38. The system of claim 23, wherein the accessory includes:

a first media driver configured to engage media within the first media input tray;

a second media driver configured to engage media along the duplex path; and a transmission operably coupled to the first media driver and the second media driver, wherein the transmission is configured to receive torque from a main unit to which the accessory is releasably mounted.

39. The system of claim 23, wherein the feed path is configured to connect to a second feed path extending into the main unit to a print device.

40. A media handling accessory for use with a main unit, the accessory comprising:

a body configured to be releasably mounted to the main unit;

means for storing and supplying media to a media path extending in the main unit; and means for receiving media from within the main unit, for overturning media within the accessory and for directing the overturned media into the main unit.

41. A media handling system comprising:

a main unit; and an accessory releasably mounted to the main unit, the accessory including:

supplying means for supplying media; and means subjacent the supplying means for overturning media within the accessory and directing the overturned media into the main unit.

42. A method comprising:

releasably mounting an accessory to a main unit;

feeding media from a tray of the accessory to the main unit;

moving media from the main unit into the accessory; and overturning the media at least partially within the accessory, wherein the step of overturning the media within the accessory occurs beneath the tray.

43. The method of claim 42 including printing upon a first side of the media in the main unit.

44. The method of claim 43 including moving the overturned media from the accessory into the main unit.

45. The method of claim 44 including printing upon a second side of the overturned media in the main unit.

46. A method comprising:

releasably mounting an accessory to a main unit, wherein the accessory includes a tray supplying media from the tray to the main unit;

overturning media beneath the tray in the accessory;

printing upon a first side of the media; and printing upon a second side of the media.

47. An apparatus comprising:

means for releasably mounting an accessory to a main unit;

means for feeding media from a tray of the accessory into the main unit;

means for moving media from within the main unit into the accessory; and means for overturning the media at least partially within the accessory.

48. An apparatus comprising:

a main unit including a print device; and an accessory releasably mounted to the main unit, the accessory including:

a first media input tray configured to supply media to a feed path of the main unit that leads to be print device; and a duplex path through which media is overturned configured to receive media that has been printed upon by the print device of the main unit.

49. A media handling accessory configured to be releasably mounted to a main unit, the accessory comprising:

a first media input tray;

a duplex path having a U-turn portion through which media is overturned while within the accessory, wherein the duplex path is configured to receive media from the main unit, is configured to overturn the media in the accessory, and is configured to return overturned media to the main unit; and a cover, wherein the cover is pivotal between a first position covering the duplex path and a second open position exposing the duplex path, wherein the first media input tray is pivotal about a first axis and wherein the cover is pivotal about a second axis.

50. A media handling accessory configured to be releasably mounted to a main unit, the accessory comprising:

a first media input tray;

a duplex path having a U-turn portion through which media is overturned while within the accessory, wherein the duplex path is configured to receive media from the main unit, is configured to overturn the media in the accessory, and is configured to return overturned media to the main unit;

a first media driver configured to engage media within the first media input tray;

a second media driver configured to engage media along the duplex path; and a transmission operably coupled to the first media driver and the second media driver, wherein the transmission is configured to receive torque from a main unit to which the accessory is releasably mounted.

* * * * *